US011542657B2

(12) United States Patent
Regier et al.

(10) Patent No.: US 11,542,657 B2
(45) Date of Patent: Jan. 3, 2023

(54) METHOD FOR FEEDING PIECES OF LAUNDRY TO AN INSERTION MACHINE

(71) Applicant: Herbert Kannegiesser GmbH, Vlotho (DE)

(72) Inventors: Eduard Regier, Leopoldshöhe (DE); Wilhelm Bringewatt, Porta Westfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 494 days.

(21) Appl. No.: 16/684,120

(22) Filed: Nov. 14, 2019

(65) Prior Publication Data

US 2020/0165771 A1 May 28, 2020

(30) Foreign Application Priority Data

Nov. 23, 2018 (DE) ..... 102018129566.9

(51) Int. Cl.
*D06F 87/00* (2006.01)
*D06F 67/04* (2006.01)

(52) U.S. Cl.
CPC ..... *D06F 87/00* (2013.01)

(58) Field of Classification Search
CPC ..... D06F 87/00; D06F 67/00; D06F 67/04; D06F 67/10
See application file for complete search history.

(56) References Cited

U.S. PATENT DOCUMENTS 4,774,505 A * 9/1988 Ueda ..... D06F 67/04 38/143
4,979,868 A * 12/1990 Ueda ..... D06F 95/00 414/800
5,169,282 A 12/1992 Ueda
(Continued)

FOREIGN PATENT DOCUMENTS

DE 3844764 C2 9/1992
DE 102014017477 A1 6/2016
(Continued)

OTHER PUBLICATIONS

European Patent Office, Europaischer Recherchenbericht (searchin a related application), dated Apr. 3, 2020.

*Primary Examiner* — Ismael Izaguirre
(74) *Attorney, Agent, or Firm* — Laurence P. Colton; Smith Tempel Blaha LLC

(57) ABSTRACT

A method that provides to partially automate the feeding of pieces of laundry to an insertion machine by steps which necessitate long distances to be traveled being performed manually. With large pieces of laundry such as, for example, tablecloths and bed sheets, for complete automation a large amount of space is required and the clamps holding corners of the pieces of laundry are required to travel long distances. To achieve this, it is provided to temporarily store the respective piece of laundry after it has been separated and before it is delivered to an insertion machine. It is furthermore provided that in a first corner of the piece of laundry is supplied or held ready by an automatic separator for an operator to manually locate the second corner of the piece of laundry. Partial automation can be achieved without the cycle time being adversely affected owing to manual handling processes.

19 Claims, 20 Drawing Sheets

(56) References Cited

U.S. PATENT DOCUMENTS

| | | | | |
|---|---|---|---|---|
| 7,555,857 | B2 * | 7/2009 | McCabe | D06F 67/04 38/143 |
| 9,988,220 | B2 * | 6/2018 | Sielermann | B65G 47/90 |

FOREIGN PATENT DOCUMENTS

| | | | | |
|---|---|---|---|---|
| EP | 0272368 | A1 | | 6/1988 |
| FR | 2336510 | A1 | * | 7/1977 |
| JP | 11114296 | A | * | 4/1999 |

* cited by examiner

METHOD FOR FEEDING PIECES OF LAUNDRY TO AN INSERTION MACHINE

CROSS REFERENCE TO RELATED APPLICATIONS

This patent application claims priority on and the benefit of German patent application number 10 2018 129 566.9 having a filing date of 23 Nov. 2018.

BACKGROUND OF THE INVENTION

Technical Field

The invention relates to a method for feeding pieces of laundry to an insertion machine in order to spread out and insert the pieces of laundry into a wringer or the like.

Prior Art

As part of the rationalization process, there is a desire in commercial laundries to rationalize the previously time-consuming and staff-intensive manual feeding of pieces of laundry to an insertion machine. For this purpose, it is already known to feed pieces of laundry to insertion machines in a fully automatic manner.

The fully automatic feeding of pieces of laundry to insertion machines is divided into two fully automatic phases. First, with the aid of a camera, the pieces of laundry are extracted from a pile of laundry at the appropriate point and separated out. Secondly, the separated pieces of laundry are for the most part, with the aid of a camera, automatically inserted with two adjacent corners of an edge into clamps and delivered automatically to loading or spreading clamps of the insertion machine. The spreading clamps hold the piece of laundry at the adjacent corners of the edge and spread them before the piece of laundry, which is unfolded as a result, is delivered by the insertion machine to an ironer or other laundry treatment machine.

In many respects, the previously known fully automatic feeding of pieces of laundry to an insertion machine has proved to be problematic. Whilst it is possible to automatically feed the pieces of laundry, after they have been gripped and separated, in a fully automatic manner to the insertion machine almost continuously with the same cycle lengths, this is not the case for the automatic gripping and separating of the pieces of laundry because it takes a different amount of time to determine the appropriate gripping point of the respective piece of laundry and occasionally several pieces of laundry are gripped at the same time. As a result, the gripping and separating of the pieces of laundry require cycles of different lengths. Moreover, in the case of large pieces of laundry such as tablecloths, bed sheets and duvet covers, a very large amount of space is required for automatically locating the second corner of the respective edge after the laundry has been automatically separated, and, owing to the long distances traveled by the clamps, this requires considerably more time than other steps during the automatic feeding of such large pieces of laundry to the insertion machine.

BRIEF SUMMARY OF THE INVENTION

Against this background, the object of the invention is to provide a method for feeding pieces of laundry to an insertion machine, which method ensures the correct balance between the degree of automation and the cycle length.

A first method achieving this object is a method for feeding pieces of laundry to an insertion machine in order to spread out and insert the pieces of laundry into a wringer or the like, wherein the pieces of laundry are preferably gripped automatically by at least one separator and then each individual piece of laundry is delivered to the insertion machine, wherein the respective piece of laundry is stored temporarily after it is separated and before it is delivered to the insertion machine.

Accordingly, it is provided to temporarily store the respective pieces of laundry at least once after they have been separated and before they are delivered to the insertion machine. Temporarily storing the laundry at least once creates a buffer between successive working and handling steps. The method can consequently be made consistent. In particular, the successive handling and working steps can thus take place consecutively continuously and/or uninterruptedly. A prerequisite for a functional sequence of automatic, semi-automatic, and/or manual tasks or actions is thus in particular created. As a result of the buffering in at least one temporary store, discontinuities caused by manual actions are thus compensated for such that automatic or semi-automatic actions can take place continuously by the storing of the laundry at least once causing the flow of the laundry to be made consistent.

It is preferably provided for in each case a single piece of laundry, hanging by a corner, to be supplied by the separator. The respective piece of laundry is preferably delivered by the corner from which it hangs from the separator to the at least one store, in particular to at least one clamp of the latter, and/or is accepted by the store. The supplying of one corner of the respective piece of laundry by the separator enables selective storage and, once removed from the store, selective further treatment in a subsequent handling step. The piece of laundry which is supplied by the separator, in each case hanging by one corner, can in particular be transferred both manually and automatically, preferably by this very same corner.

An advantageous possible development of the method provides to deliver the pieces of laundry, sorted, into at least one store for sorted pieces of laundry, namely a sorting store. The respective sorting store preferably has multiple storage tracks for each sort of piece of laundry. The sorted pieces of laundry can then be retrieved, correctly sorted, from the respective storage track.

The sorted pieces of laundry are preferably moved from the temporary store and/or at least one identification device into the at least one sorting store. The sorting thus preferably takes place when the pieces of laundry are delivered from the temporary store or the identification device into the at least one sorting store by the pieces of laundry being moved into the respective storage track of the sorting store in a selective fashion, especially controlled by the identification device.

Another possible further development of the method provides to carry out an identification of the respective piece of laundry, preferably with respect to at least one sorting criterion for said laundry, upstream from the at least one sorting store. The identification preferably takes place using an identification device with, for example, an imaging device. The respective piece of laundry may thus be identified by the identification device in the region of a temporary store upstream from the at least one sorting store. The pieces of laundry can then be moved in a selective manner, sorted, into the respective storage track of the sorting store and stored, correctly sorted, in the respective storage track.

Additional further developments of the above described method as claimed in one or more of the claims herein.

A further method for achieving the object mentioned at the beginning is a method for feeding pieces of laundry to an insertion machine in order to spread out and insert pieces of laundry into a wringer or the like, wherein the pieces of laundry are gripped and separated automatically and then each individual piece of laundry is delivered to the insertion machine with adjacent corners of an edge, wherein a piece of laundry held by a first corner is in each case held ready by the separator. In this method, it is provided to supply from the automatic separator in each case one piece of laundry, held by one corner, for forwarding to an identification device, at least one temporary store, at least one sorting store, and/or for manual delivery. By virtue of the supplying in this manner of one corner of the respective piece of laundry by the separator, selective further treatment, selective onward transporting, and/or selective subsequent handling of a manual or automated type can take place reliably.

It is preferably provided that the respective piece of laundry hangs down loosely from a first corner held by the automatic separator. This makes it possible to easily find and grip another (second) corner by hand. It is in particular made easier for an operator to grip the second corner if the piece of laundry is supplied by the separator in such a way that the lower tip and/or the second corner of the loosely hanging down piece of laundry hangs at an ergonomically appropriate height above the floor.

According to an advantageous development of the method, it is provided that at least one second corner, adjacent to the first corner supplied by the separator, of an edge of the piece of laundry is inserted manually into a clamp. The first corner can be inserted automatically or alternatively manually into a clamp. The clamp is, for example, at least one clamp of an insertion machine which holds the piece of laundry by adjacent corners of an edge, in particular a front edge, and stretches this edge.

An advantageous possible embodiment of the method provides to manually locate, in the region of the at least one temporary store, the second corner, adjacent to the first corner held in a clamp of the at least one temporary store, of the edge of the piece of laundry and to insert this second corner preferably also manually into the second clamp of the temporary store. As a result, the second corner of the piece of laundry, which is hard to locate automatically in particular in the case of large pieces of laundry, is located manually and thus inserted into the second clamp of the temporary store. Surprisingly, this has proven to be reliable and in particular quicker than automatically locating the loosely hanging down second corner of the piece of laundry and automatically inserting it into a second clamp.

Alternatively, it is conceivable, in the region of the at least one sorting store, to locate manually the second corner, adjacent to the first corner held in a clamp of said store, of the piece of laundry and/or also to insert it manually into the second clamp of the sorting store. Also in the region of the at least one sorting store, in particular in the case of large pieces of laundry, it has proven to be simpler to locate the second corner manually and insert it into a second clamp of the sorting store.

Another possible further development of the method provides to insert, at the end of the at least one temporary store or sorting store, at least one of the adjacent corners of the edge of the piece of laundry to be spread by the insertion machine manually into a clamp, in particular a loading clamp or spreading clamp, of the insertion machine. It is thus also conceivable to insert both adjacent corners of the edge manually into two clamps, in particular loading or spreading clamps, of the insertion machine. The clamps, in particular spreading clamps, can be separate, individually movable clamps but can also, and to be precise in particular in the case of loading clamps, be interconnected clamps designed in the manner of a double clamp. The manual insertion of especially both adjacent corners of the edge which is to be spread into the insertion machine has the advantage that the corners are accurately oriented and can be inserted into the clamps at the outermost points, which improves the quality of the later treatment of the piece of laundry, in particular the ironing quality of the piece of laundry, in comparison with the automatic insertion or transfer.

In the case of the piece of laundry supplied to the operator by the automatic separator, it is preferably provided to insert the respective piece of laundry into the insertion machine manually with the first corner supplied by the separator and the second corner of the edge. In this embodiment of the method, it is ensured that the adjacent corners of an edge to be spread by the insertion machine are inserted into clamps of the insertion machine by the shortest possible route. The automatic separator here frees the operator from the difficult and strenuous tasks of picking and pulling out a first corner of the piece of laundry from the pile of laundry. The separator moreover makes it easier for the operator to find and grip the second corner which hangs down from the first corner. This is in particular the case when the separator holds the piece of laundry a sufficient distance from the floor such that the operator can consistently easily grip the upper corner and the lower second corner and insert them directly into clamps, and to be precise loading clamps or spreading clamps, of the insertion machine.

Another advantageous possible embodiment of the method provides to transfer the piece of laundry, held by the separator at a first corner and supplied in this way, with this corner automatically from the separator or deliver it from the separator. The first corner of the piece of laundry is preferably automatically delivered from the separator to a clamp of the at least one temporary store, the at least one sorting store, or an identification device and/or is transferred by said clamp. As a result, the respective piece of laundry passes automatically from the separator to the at least one temporary store, at least one sorting store, or the at least one identification device.

After the first corner of the piece of laundry is automatically transferred/delivered by/to a clamp of the at least one temporary store, the at least one sorting store, or the at least one identification device, the second corner of the edge, preferably the edge extending from the insertion machine, of the piece of laundry is preferably located manually and inserted into a clamp provided for it. The clamp can here also be a clamp of the temporary store, the sorting store, or the identification device. Semi-automatic delivery of the clamp is provided as part of this process, wherein the first corner is automatically delivered by the separator but the second edge is delivered manually. This delivery of the clamp and/or corners, which takes place in a mixed automatic and manual fashion, is particularly suitable for large pieces of laundry where looking for and grasping the second edge, which hangs down low from the separator, of the piece of laundry would mean complex machinery and a large amount of time and could in particular also result in errors.

The method can furthermore be designed such that the respective piece of laundry is delivered from the at least one temporary store or at least one sorting store with both adjacent corners of the edge to be spread by the insertion machine, automatically to the insertion machine, preferably to loading clamps or spreading clamps thereof. In this method, at least the separation of the pieces of laundry and the delivery of at least one corner thereof to the respective clamps of the insertion machine is automated. Manual steps can take place between the separation and the delivery to the insertion machine, in particular hanging at least the second corner of the separated piece of laundry in a corresponding clamp of the temporary store and/or the sorting store. Steps or transfers which are to be automated simply are thus performed automatically, whilst, in particular in the case of large pieces of laundry such as bed sheets, in particular king-size bed sheets, tablecloths, or duvet covers, the steps or transfers which are complex or simply inaccurate to perform automatically take place manually.

In an advantageous possible development of the method, it is provided for the fit or position of the at least one corner, inserted automatically into a clamp, of the piece of laundry to be checked visually by a person or imaging device and if necessary corrected. It is consequently possible, despite the automatic insertion and/or delivery of at least one corner into/from a clamp into another, to intervene manually where necessary to make corrections if this proves to be necessary because of high quality requirements for the ironing or finishing quality of the pieces of laundry.

BRIEF DESCRIPTION OF THE DRAWINGS

Preferred exemplary embodiments of the invention are explained in detail below with the aid of the drawings, in which.

DETAILED DESCRIPTION OF PREFERRED EMBODIMENTS

Figure 1:
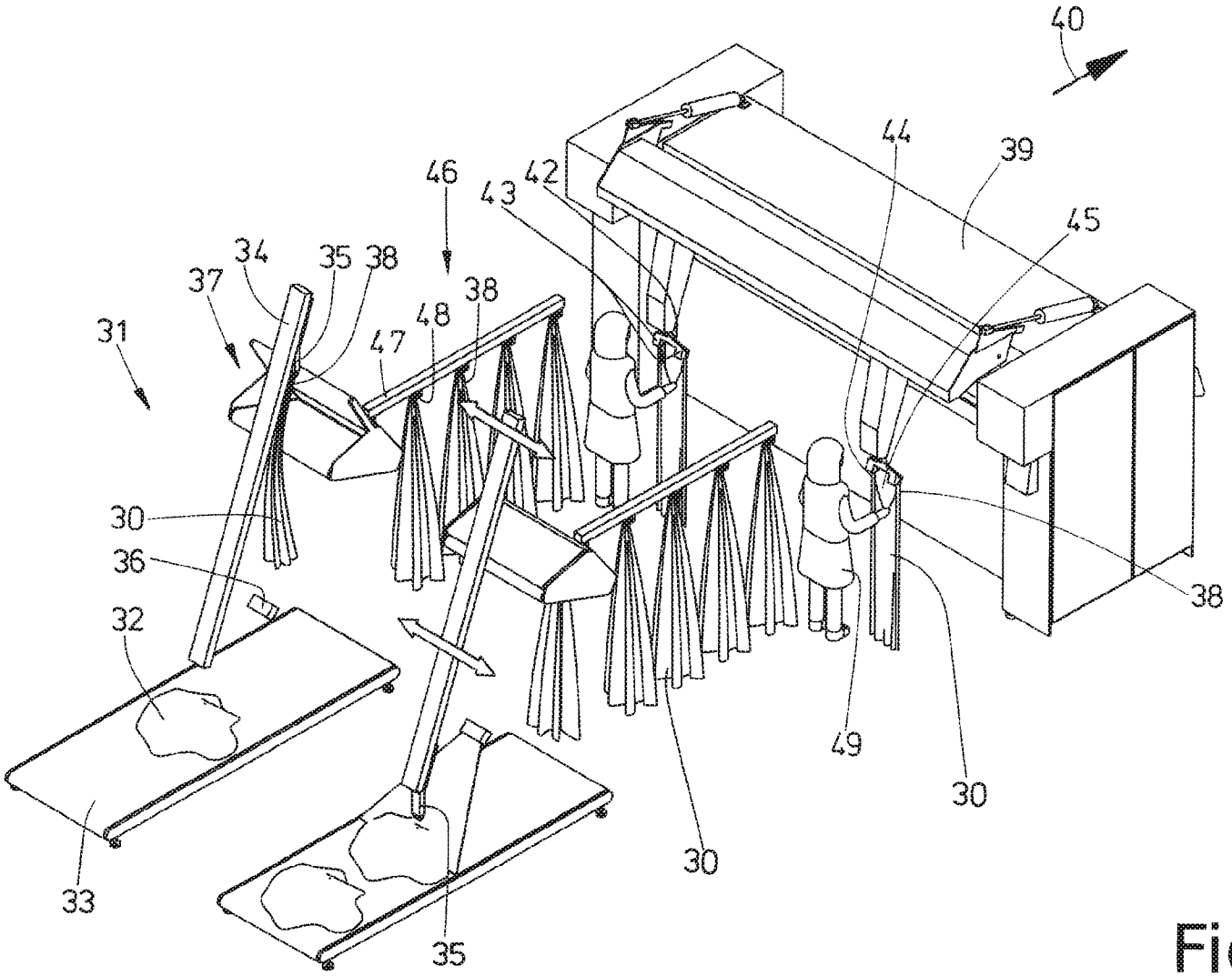
FIG. 1 shows a perspective view of a device for performing the method.

The devices shown in the figures illustrate different exemplary embodiments of the method according to the invention. For the sake of greater clarity, identical components and parts of the devices shown are here provided with the same reference numerals.

The devices are provided to feed pieces of laundry 30 to input machines 39 in an at least partly automated manner. The input machines 39 spread out the pieces of laundry 30 and insert them, once spread out, into an ironer or other laundry treatment machine. The pieces of laundry 30 are preferably so-called flatwork. The devices shown and the methods which can be performed using them are in particular provided for large items of flatwork such as tablecloths, duvet covers, and bed sheets.

The different exemplary embodiments and devices for performing the method according to the invention which are shown in the figures have at least one separator 31 for automatically gripping and separating pieces of laundry 30. In the exemplary embodiment shown, the pieces of laundry 30 are fed to the respective separator 31 in batches as piles of laundry 32 from a belt conveyor 33. In the exemplary embodiments in FIGS. 1 to 8 and 11 to 20, two preferably identical separators 31 are arranged next to each other in parallel. However, the invention is not limited to this. It is also suited for a single separator 31 but also for more than two separators 31, for example according to the exemplary embodiment in FIGS. 9 and 10 six preferably identical separators 31 arranged next to one another.

Each separator 31 has an inclined section 34. A gripper 35 can be moved up and down along the inclined section 34. The inclined section 34 with the gripper 35 can moreover be displaced laterally. The piles of laundry 32 can be advanced in the transport direction by the belt conveyor 33 but also be reversed. At least one image of the pile of laundry 32 is generated by the at least one imaging device, for example a 3D camera 36, and this image is used to determine the most favorable point at which the gripper 35 can grip a piece of laundry 30 in the pile of laundry 32.

The separator 31 furthermore has a supply device 37. The piece of laundry 30 which is picked up by the gripper 35 is delivered to the supply device 37 by traveling upward along the inclined section 34 which extends preferably obliquely upward. The supply device 37 has multiple purposes. Firstly, in the case of simultaneous gripping of multiple pieces of laundry 30 by the gripper 35, it serves to reliably definitively separate them. Secondly, the supply device 37 serves to supply a first corner 38 of the piece of laundry 30 for further treatment and/or onward transport. For this purpose, the individually gripped piece of laundry 30, or alternatively pieces of laundry 30 gripped simultaneously at multiple points, passes through the supply device 37, wherein the final separation takes place and the piece of laundry 30 continues to be held by the supply device 37 only by the rearmost corner in the direction of passage through the supply device 37, in other words the first corner 38 of the supply device 37. The piece of laundry 30 then hangs down, held loosely at the first corner 38 by the supply device 37. In this state, the automatically separated piece of laundry is supplied for feeding to the insertion machine 39. The pieces of laundry 30 are transported from the separator 31 to the insertion machine 39 in a direction which is referred to below as the feed direction 40. This is also the direction in which the insertion machine 39 feeds the piece of laundry 30, spread out or stretched by it, to a downstream laundry treatment device, in particular an ironer not shown in the figures.

In FIGS. 1 to 8 and 11 and 20, an insertion machine 39 is shown in each case. This insertion machine 39 has two or alternatively more than two loading points 41, arranged next to one another, but possibly also just a single loading point 41. At least one double clamp 42 with two loading clamps 43, hanging together but spaced apart from each other, is associated with each loading point 41. The two adjacent loading clamps 43 and the respective double clamp 42 are filled with the first corner 38 and a second corner 44, adjacent to the latter, of an edge of the respective piece of laundry 30. This edge 45, which can also be referred to as the front edge or leading edge 45 in the feed direction 40, is stretched by a spreading device of the insertion machine 39 which is not shown in the figures and the piece of laundry 30 is thus spread out. For this purpose, the double clamp 42 with loading clamps 43 holding the two adjacent corners 38, 44 of the edge 45 is moved to in each case one pair of spreading clamps which transfers the two corners 38 and 44 and then stretches the edge 45 by moving apart the spreading clamps.

Figure 9:
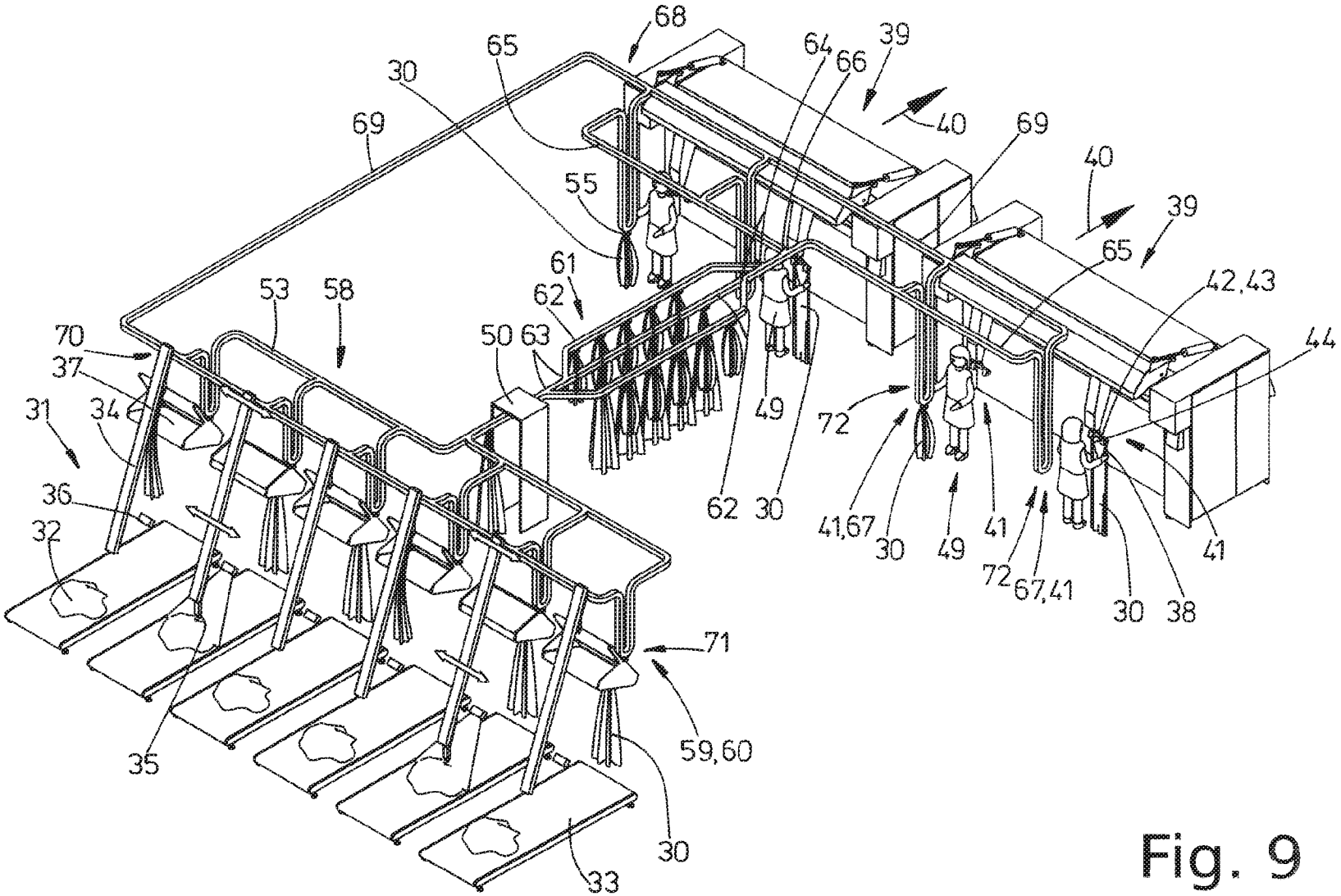
FIG. 9 shows a perspective view of a device for performing the method according to a fifth exemplary embodiment of the invention.
Figure 10:
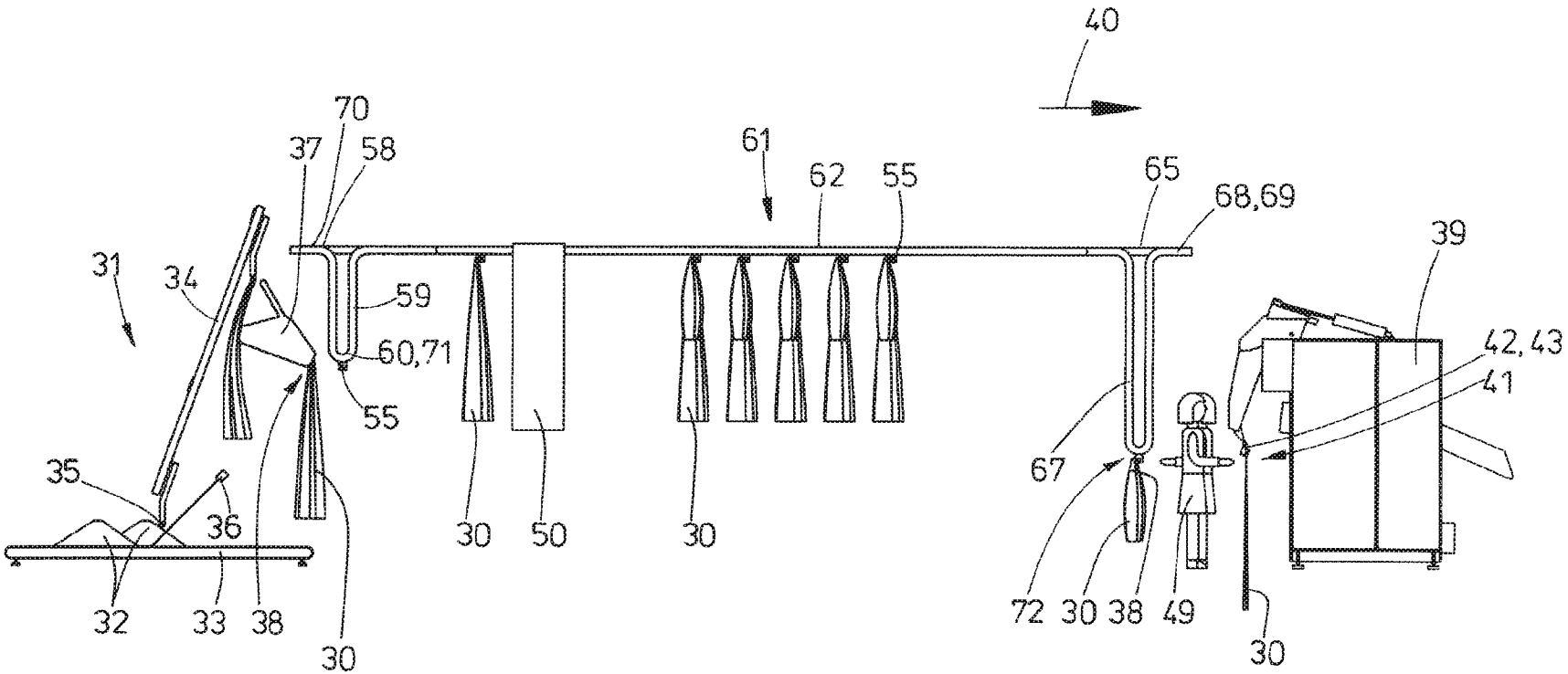
FIG. 10 shows a side view of the device in FIG. 9.

An exemplary embodiment of a device with six identical separators 31 which are arranged next to one another and downstream from which are arranged two preferably identical insertion machines 39 arranged next to each other is shown in FIGS. 9 and 10.

Figure 2:
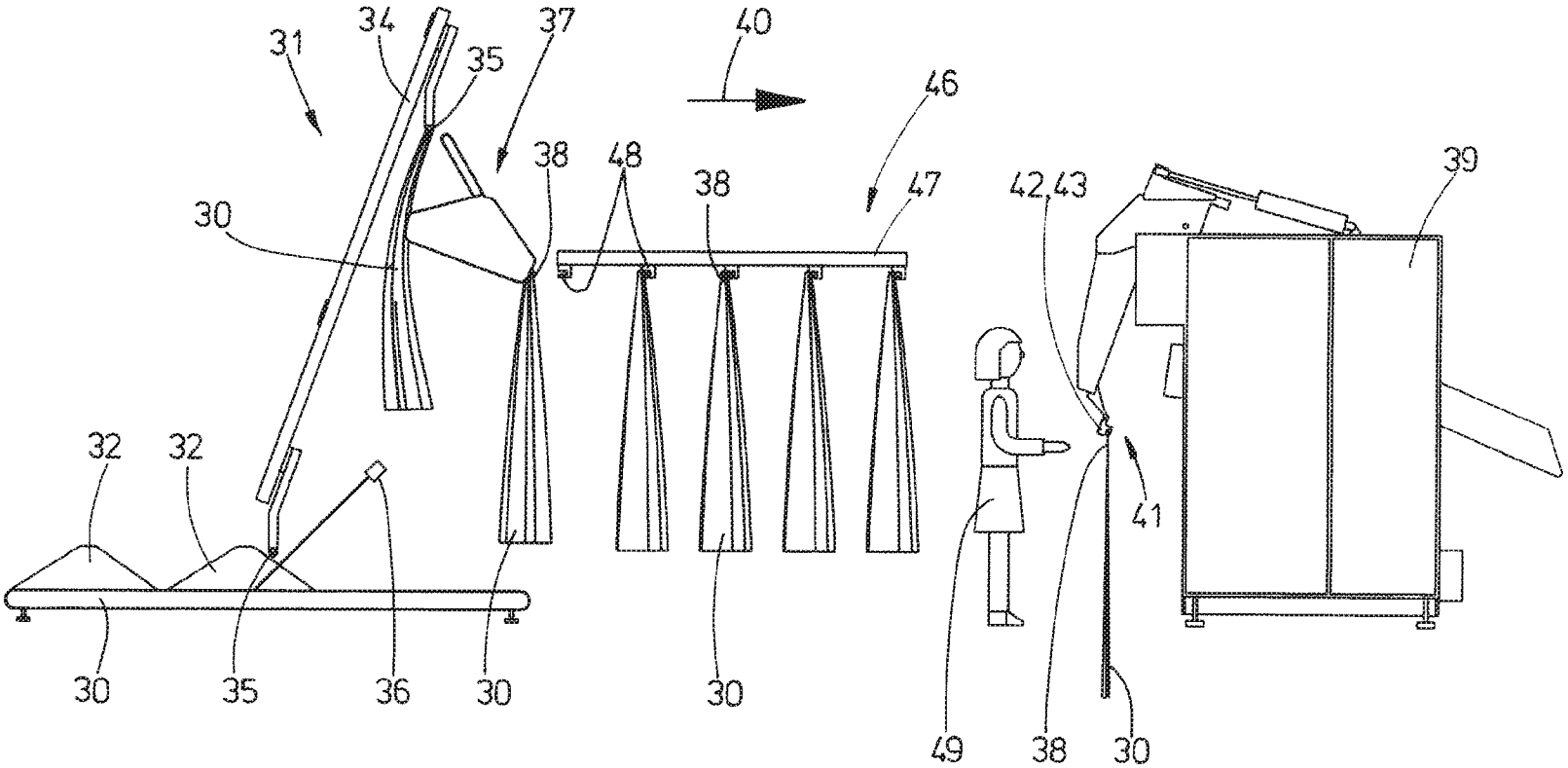
FIG. 2 shows a side view of the device in FIG. 1.

In the first exemplary embodiment in FIGS. 1 and 2, an automatic separator 31 is associated with each loading point 41 of the insertion machine 39. A temporary store 46 is situated between the respective separator 31 and the loading point 41, associated with the latter, of the insertion machine 39. The two parallel temporary stores 46 have the same design. In the exemplary embodiment shown, the respective temporary store 46 has a straight conveyor rail 47, which is horizontal or inclined slightly downward in the feed direction 40, on which the multiple clamps 48 can be displaced in the feed direction 40 by means of conveying means (not shown). A piece of laundry 30 is held on each clamp 48 by the first corner 38, wherein, in the exemplary embodiment shown, multiple individual pieces of laundry 30 are received simultaneously in the respective temporary store 46, hanging down from clamps 48. Depending on the size of the temporary store 46, the number of the pieces of laundry 30 which are simultaneously temporarily stored or buffered herein can vary according to requirements. It is also conceivable that the temporary store 46 can receive just a single piece of laundry 30. Nevertheless, it still qualifies as a temporary store 46 within the sense of the invention because the piece of laundry 30 can wait here until it can be inserted into the loading clamps 43 of the insertion machines 39.

The conveyor rail 47 is designed such that multiple clamps 48 can be transported back in or on it from that end of the conveyor rail 47 facing the insertion machine 39 to the start of the same in order to form a closed loop for the clamps 48. This loop is not shown in FIGS. 1 and 2 for reasons of simplicity.

Using the device in FIGS. 1 and 2, the method according to the invention proceeds as follows:

The respective individual piece of laundry 30 passes from the separator 31 to the start of the temporary store 46. The piece of laundry 30 is here held by the separator 31 at the first corner 38, and to be precise such that it hangs down loosely from the first corner 38. The piece of laundry 30 supplied by the separator 31 is then delivered to a free clamp at the start of the temporary store 46. This can be effected by the separator 31 and/or when the clamp 48 of the temporary store 46 which takes the piece of laundry 30 from the separator 31 approaches the separator 31. After this delivery, the first corner 38 of the piece of laundry 30 is situated in the clamp 48 of the temporary store 46. The piece of laundry 30 here hangs down loosely from the clamp 48.

A piece of laundry 30 hanging at that end of the temporary store 46, namely the conveyor rail 47 thereof, which faces toward the insertion machine 39 is then delivered manually by an operator 49 with the adjacent corners 38 and 44 of the front edge 45 into the two loading clamps 43 of the double clamps 42 of the loading point 41 of the insertion machine 39 which is associated with the temporary store 46. The operator 49 first grasps the free second corner 44 of the piece of laundry 30 hanging down in front of the clamp 48 of the temporary store 46. The operator 49 then removes the first corner 38 of the piece of laundry 30 from the clamp 48 of the temporary store 46 and inserts it into the second loading clamp 42 of the double clamp 42. The two adjacent corners 38 and 44 of the edge 45 of the piece of laundry 30 are then delivered automatically from the double clamp 42 holding said corners to the spreading clamps of the spreading device which stretch the edge 45 of the piece of laundry 30 by moving apart from each other, and feed the piece of laundry 30 spread out in this way to the ironer or the like situated downstream from the insertion machine 39.

Figure 3:
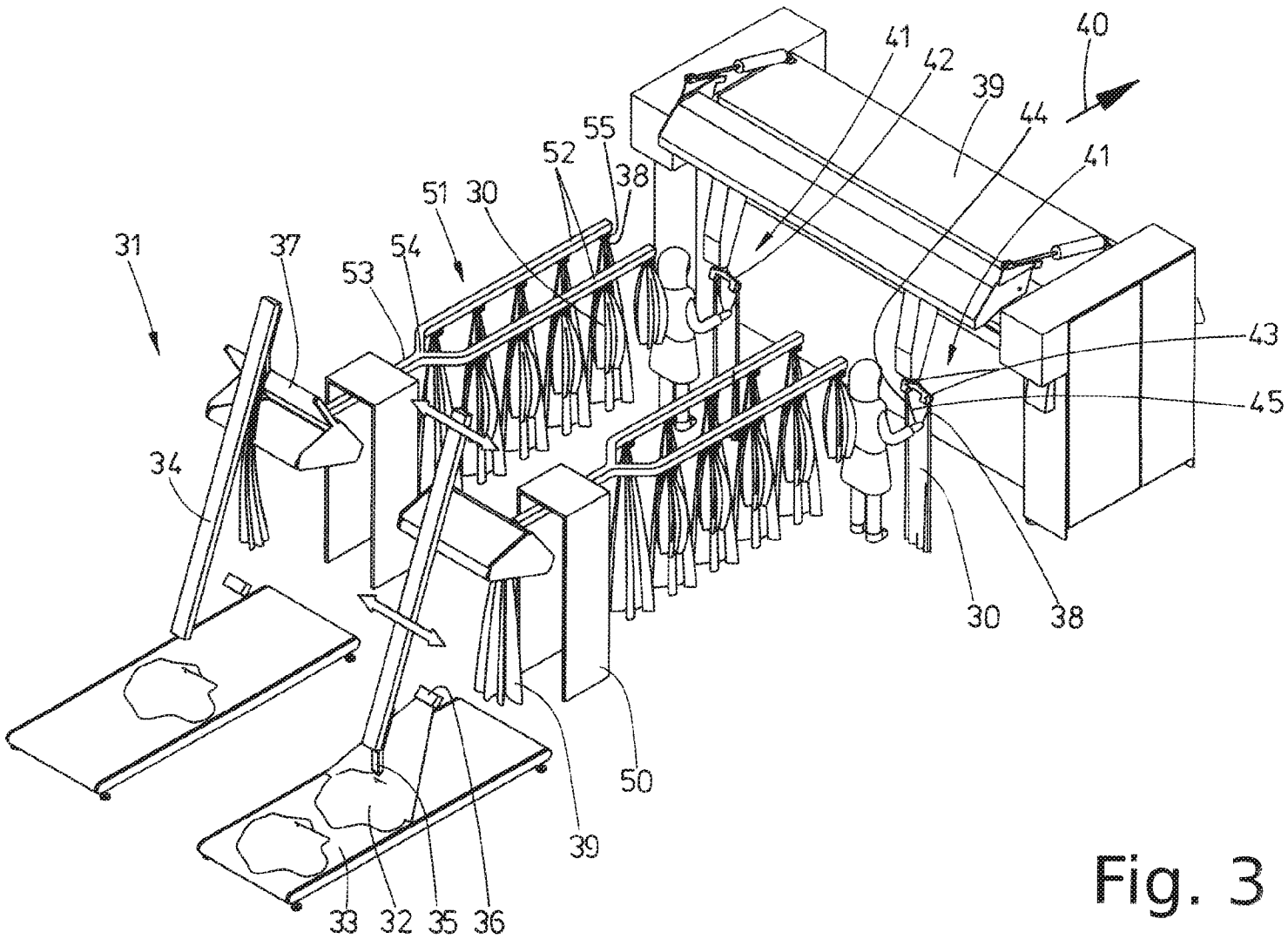
FIG. 3 shows a perspective view of a device for performing the method according to a second exemplary embodiment of the invention.
Figure 4:
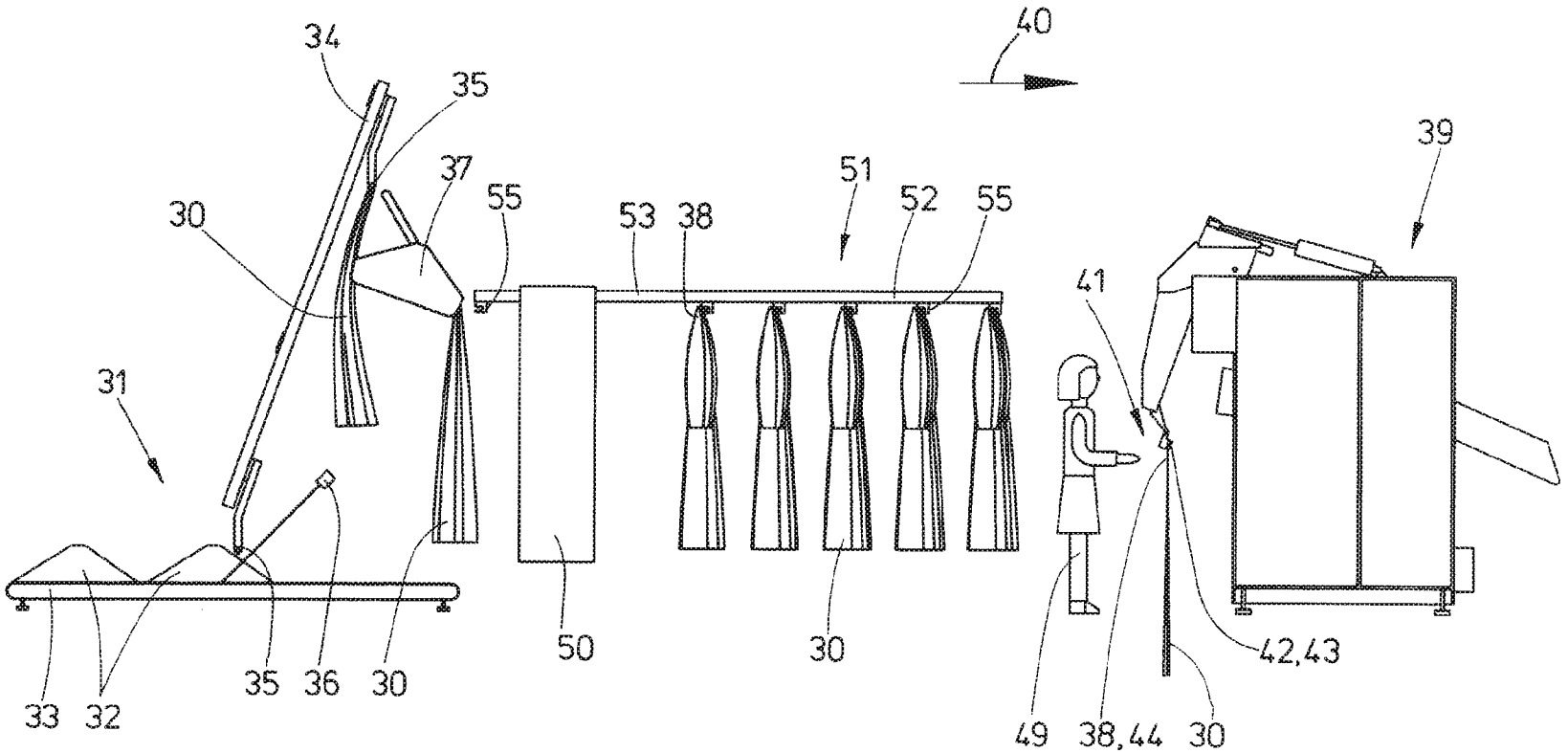
FIG. 4 shows a side view of the device in FIG. 3.

In the exemplary embodiment in FIGS. 3 and 4, as in the exemplary embodiment described above, two separators 31 situated next to each other and an insertion machine 39 situated downstream in the feed direction 40 with two adjacent loading points 41 are provided.

An identification device 50 for forming an identification station and a sorting store 51 are provided between each separator 31 and the loading point 41 of the insertion machine 39 situated downstream from the separator. A conveyor rail 53, which is straight in the exemplary embodiment shown, extends through the identification device 50 from the separator 31 to the sorting store 51. In the exemplary embodiment shown, the sorting store 51 has two parallel storage tracks 52 which, in the exemplary embodiment shown, are the same length and extend parallel to each other. It is, however, also conceivable that the sorting store 51 has more than two storage tracks 52. It is moreover conceivable that the two or more than two storage tracks 52 have profiles or alternatively lengths which deviate from each other. A switch 54 is situated between the two storage tracks 52 at the transition to the conveyor rail 53, associated with the identification device 50.

Clamps 55 can be displaced on the conveyor rail 53 and the storage tracks 52 of the sorting store 51 in order to receive in each case a first corner 38 of a piece of laundry 30. The clamps 55 can be displaced on the conveyor rail 53 and the storage tracks 52. Their clamps 55 can be moved back behind the respective storage tracks 52 on sections (not shown) of the conveyor rail 53 to the start of the conveyor rail 53 in the region of the respective separator 31.

The identification device 50 has at least one imaging device, for example a camera not shown in the figures, wherein it is preferably a 3D camera. The camera can be a color camera in the event that it is intended to sort into colored and white pieces of laundry 30.

The device in FIGS. 3 and 4 otherwise corresponds to the device in FIGS. 1 and 2.

The method according to the invention proceeds using the device in FIGS. 3 and 5 in the following manner:

The first corner 38 supplied by the respective separator 31 is delivered automatically to a clamp 55 at the start of the conveyor rail 53. This delivery is preferably effected by the separator 31.

By virtue of the delivery of the piece of laundry 30 to the clamps 55, automatic delivery of the piece of laundry 30 to the conveyor rail 53, which can also form a temporary store 46, takes place. At the same time, automatic delivery of the piece of laundry 30 to the identification device 50 takes place. The piece of laundry 30 identified by the at least one imaging device of the identification device 50 is transported onward along the conveyor rail 53 in the feed direction 40 to the switch 54. The switch 54 is adjusted by the identification device 50, preferably an evaluation unit, depending on the result of the identification of the piece of laundry 30 such that the piece of laundry 30 is moved, with the clamp 55 carrying it, into that storage track 52 of the sorting store 51 with which the at least one sorting criterion corresponding to the piece of laundry 30 is associated. In this way, pieces of laundry 30 with different sorting criteria pass into the two storage tracks 52, wherein the sorting criteria for each storage track 52 are the same such that the pieces of laundry 30 identified by the identification device 50 are moved, correctly sorted, into the respective storage track 52 of the sorting store 51 and the pieces of laundry 30 are thus sorted.

The pieces of laundry 30 can be inserted, correctly sorted, into the insertion machine 39 from one or other storage track 52. In the exemplary embodiment shown, this insertion takes place manually and to be precise by an operator 49 assigned to both storage tracks 52 at the end of the respective sorting store 51 of the corresponding loading point 41 of the insertion machine 39. The respective operator 49 takes hold of in each case one piece of laundry 30 supplied at the end of the respective storage track 52 in order to insert it manually into the loading clamps 43 of the double clamp 42. This insertion takes place in exactly the same fashion as explained in the method in connection with the exemplary embodiment in FIGS. 1 and 2. In this exemplary embodiment, the operator 49 simply removes the respective piece of laundry 30 from that storage track 52 from which it is intended to insert the next piece of laundry 30 manually into the loading clamps 43 at the loading point 41 of the insertion machine 39. The operator 49 here usually proceeds such that he/she removes pieces of laundry 30 of the same sort one after the other from the same storage track 52 leading to the insertion machine 39. Sorted pieces of laundry 30 in the sorting store 51 are consequently passed through the ironer correctly sorted. The operator 49 can, for example, hang all the pieces of laundry 30 which are situated in a storage track 52 in the double clamp 42 of the insertion machine 39 and, after processing one sort of pieces of laundry 30 can insert pieces of laundry 30 of a different type, one after the other, from the adjacent storage track 52 into the insertion machine 39.

Figure 5:
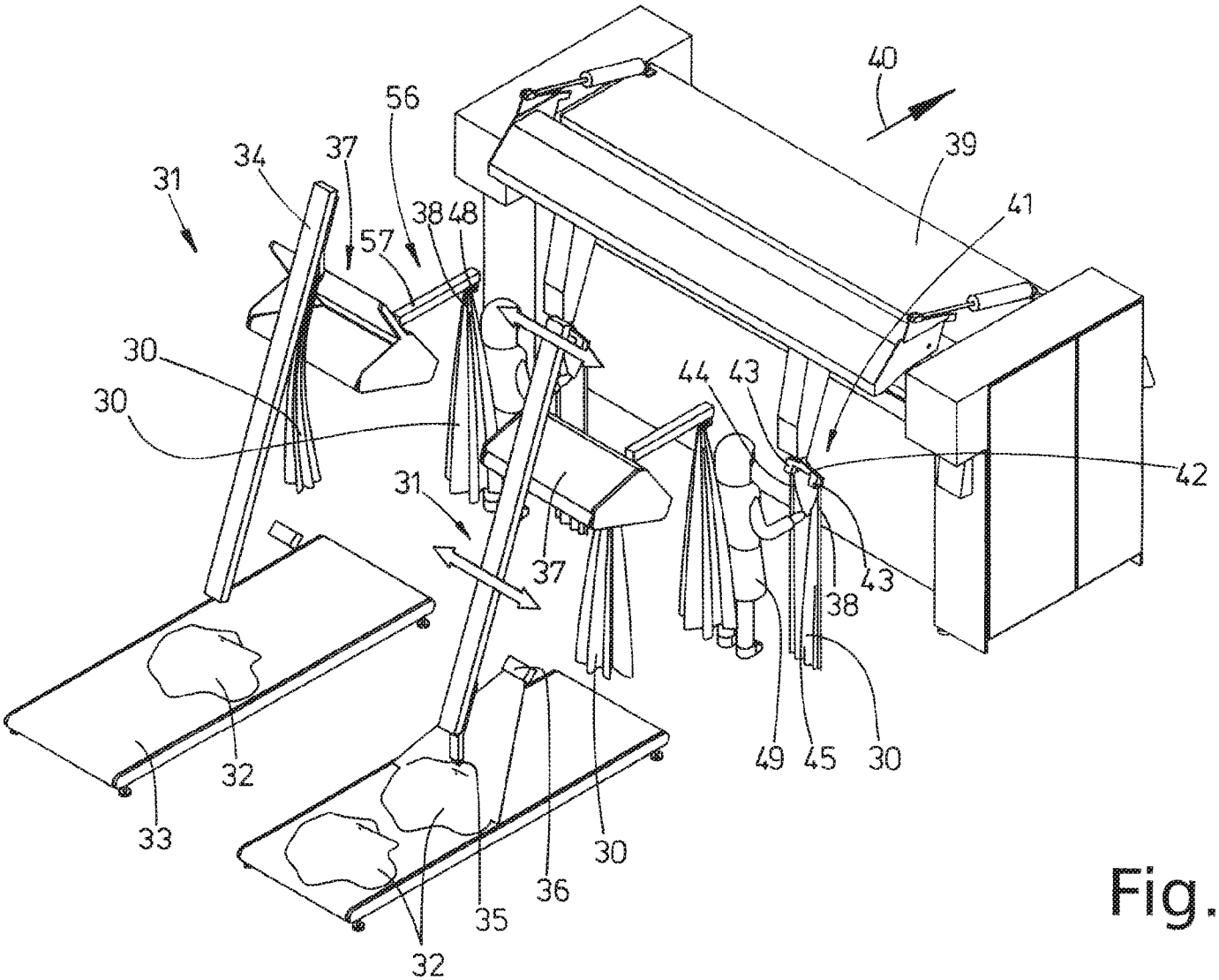
FIG. 5 shows a perspective view of a device for performing the method according to a third exemplary embodiment of the invention.
Figure 6:
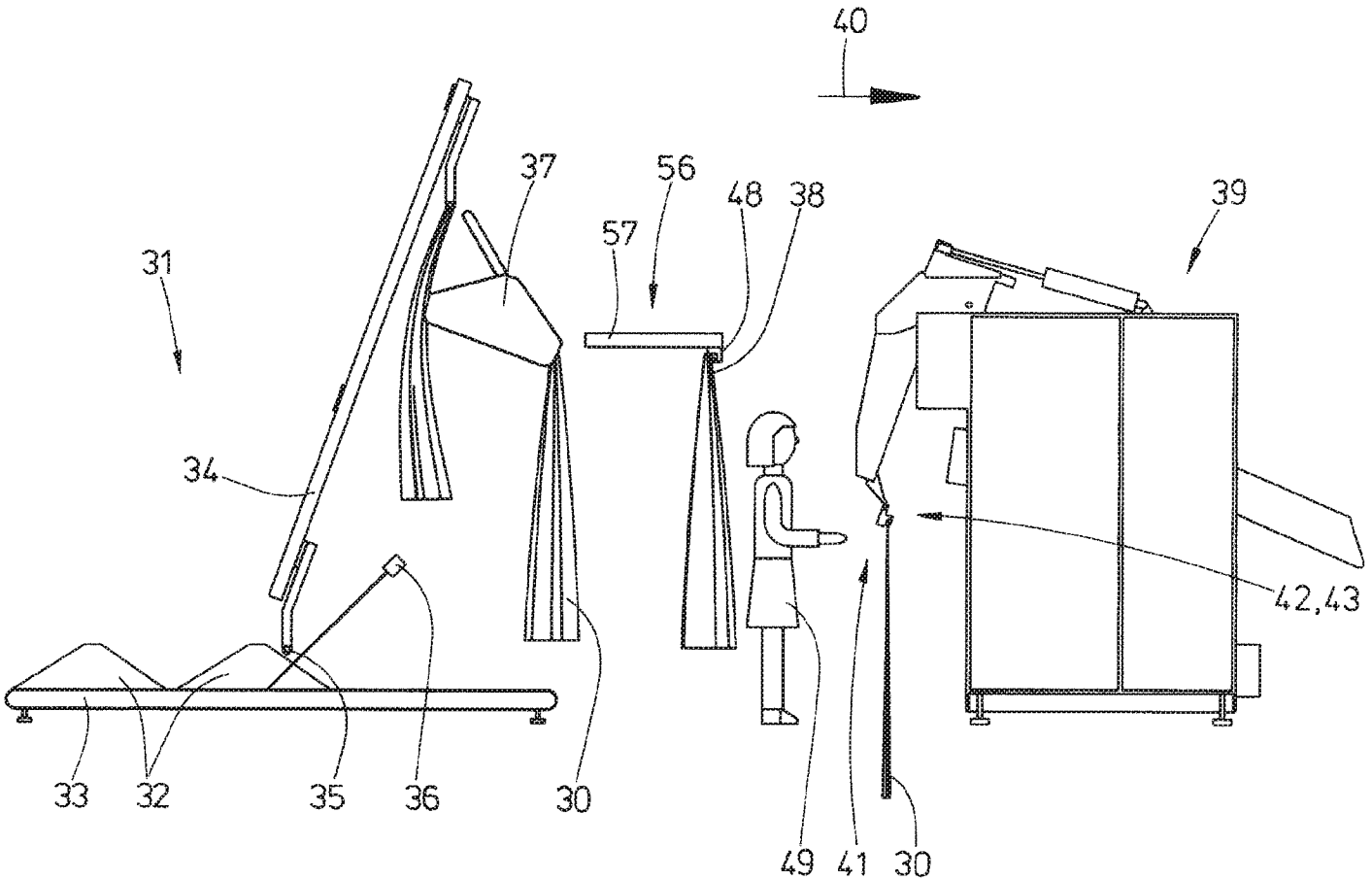
FIG. 6 shows a side view of the device in FIG. 5.

The device shown in FIGS. 5 and 6 corresponds in principle to the device in FIGS. 1 and 2. This device just has a temporary store 56 with a shorter conveyor rail 57. Each temporary store 56 is therefore designed just to receive in each case one piece of laundry 30. It is nevertheless a temporary store 56 because the pieces of laundry 30 can remain on the conveyor rail 57 until they can be inserted into the insertion machine 39 by the operator 49, in other words when the double clamp 42 serving this purpose is free again.

The temporary store 56 needs to have just a single clamp 48. It can, however, also have two clamps 48 such that when a clamp 48 which holds a piece of laundry 30 at the first corner 38 is situated at that end of the conveyor rail 57 associated with the insertion machine 39, an empty clamp 48 is already available at the separator 31 to deliver or transfer the next piece of laundry 30.

The method according to the invention proceeds with the device in FIGS. 5 and 6 in principle in exactly the same fashion as in the case of the device in FIGS. 1 and 2 such that reference is made to the method described in connection with this device.

Figure 7:
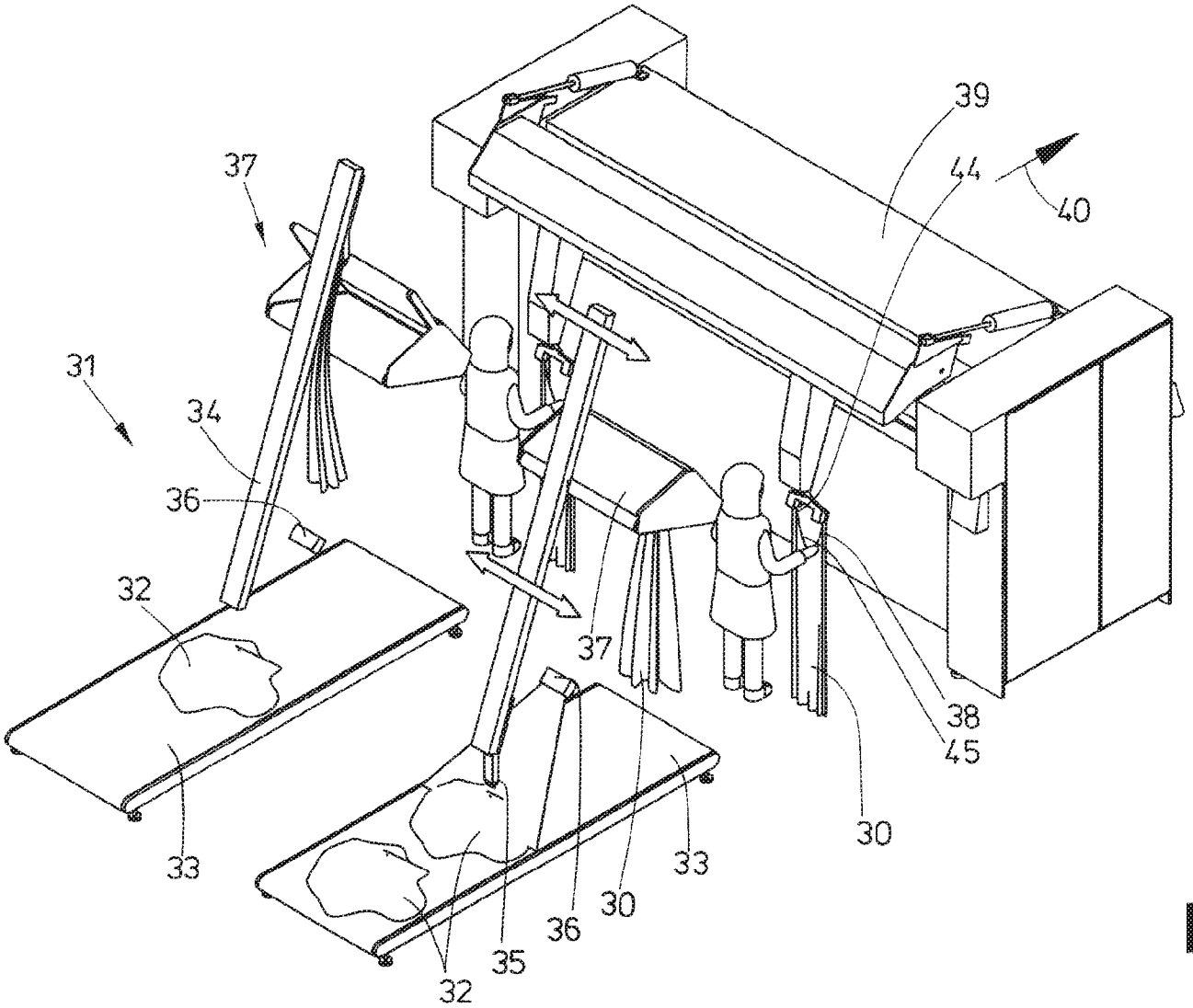
FIG. 7 shows a perspective view of a device for performing the method according to a fourth exemplary embodiment of the invention.
Figure 8:
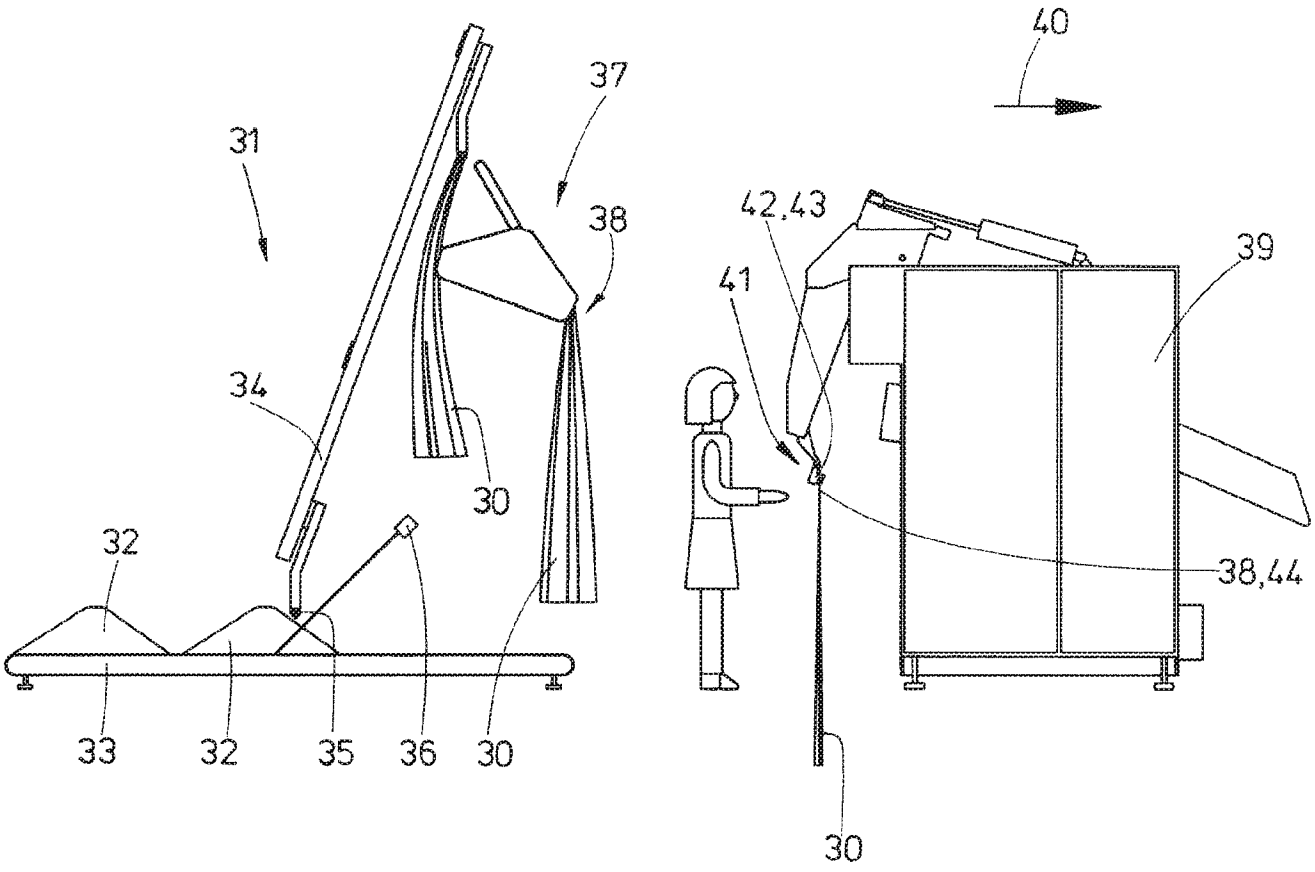
FIG. 8 shows a side view of the device in FIG. 7.

The device shown in FIGS. 7 and 8 differs from the above described devices in that it has neither a temporary store 46 or 56 nor a sorting store 51 and also no identification device 50. This device otherwise corresponds to the above described devices.

With the device in FIGS. 7 and 8, the method according to the invention proceeds such that a single piece of laundry 30 is made available or supplied to the operator 49 by the separator 31. The separator 31 here holds the piece of laundry 30 at its first corner 38. The piece of laundry 30 held at the first corner 38 hangs down loosely from the separator 31, and to be precise preferably at a height which allows the operator 49 to find and grip the second corner of the piece of laundry 30 still held at the first corner 38 of the separator 31 in an ergonomically favorable manner.

The operator 49 manually inserts both corners 38 and 44 of the edge 45 of the piece of laundry 30 one after the other into the respective loading clamp 43 of the double clamp 42 of the insertion machine 39. The operator 49 here first finds and grasps the second corner 44 of the piece of laundry 30 which hangs down loosely from the separator 31 and inserts it into the first loading clamp 43. The operator 49 then removes from the separator 31 the first corner 38 of the piece of laundry 30 still held by the separator 31 and inserts this first corner 38 of the piece of laundry 30 into the second loading clamp 43 of the double clamp 43 at the loading point 41 of the insertion machine 39.

The exemplary embodiment in FIGS. 9 and 10 corresponds in principle to that in FIGS. 3 and 4 except that here two preferably identical insertion machines 39 are provided with in each case, for example, two loading points 41 and accordingly more than two (six in the exemplary embodiment shown) identical separators 31.

All the separators 31 are connected to a collecting conveyor 58. The collecting conveyor 58 has a U-shaped transfer loop associated with each separator 31. Viewed in the feed direction 40, a curved redirection point 60 of each transfer loop 59 follows the respective separator 31.

All the transfer loops 59 of the collecting conveyor 58 together lead to a single conveyor rail 53 which extends through a single common identification device 50. This identification device 50 preferably corresponds to that in FIGS. 3 and 4. The conveyor rail 53 transitions into a sorting store 61 which differs from the above described sorting store 51 in that it preferably has three parallel storage tracks 62. By virtue of two successive switches 63, a right-hand storage track 62 first branches off from the conveyor rail 53 and then a left-hand storage track 62. The third storage track 62 of the sorting store 61 extends continuously as an extension of the conveyor rail 53.

In the case of the sorting store 61 of this exemplary embodiment, at the end of the sorting store 61, the storage tracks 62 also together return, via corresponding connection nodes 64, to a section of the conveyor rail 53 which represents an extension of the central storage track 62. The sorting store 61 branches into two feed tracks 65 at the end of the (extended) central storage track 62 which continues beyond the connection nodes 64. A switch is provided behind this branching point. The feed paths branch in such a way that sorted pieces of laundry from the respective storage track 62 of the sorting store 61 can be transported, in a selective and correctly sorted manner, to one or other of the two insertion machines 39 arranged next to each other. Each feed track 65 is here furthermore designed such that it has a delivery loop 67, which preferably extends in a vertical plane, upstream from each of the two loading points 41 of each insertion machine 39. In the exemplary embodiment shown, the two insertion machines 39 arranged next to each other supply four loading points 41 with which in each case one delivery loop is associated. An operator 49 is situated next to each delivery loop 67.

In contrast to the above described exemplary embodiments in FIGS. 1 to 8, in FIGS. 9 and 10 return routes 68 for empty clamps 55 are also shown. Each return route 68 has an initial part, starting from each delivery loop 67, which joins up with a common return rail 69. At the separators 31, a feed route 70 for feeding the clamps 55 to the respective separator 31 branches off from the return rail 69. This feed route 70 merges into the transfer loop 59 in the region of each separator 31.

The method according to the invention is explained below with the aid of the device in FIGS. 9 and 10:

A lower U-shaped redirection point 60 of each transfer loop 59 upstream from a separator 31 forms a transfer point 71. The first corner 38 of a piece of laundry 30 held by the separator 31 associated with this transfer point 71 is transferred or delivered to a clamp 58, supplied at the transfer point 71, of the collecting conveyor 58. This delivery takes place in such a way that the first corner 38 is pushed into the clamp 55 by the separator 31 or the clamp 55 picks up the first corner 38 from the separator 31.

After a respective piece of laundry 30 is automatically delivered by the separator 31 to the clamp 55, which is supplied in front of said separator, the clamp 55, with the piece of laundry 30 held thereon by the first corner 38, is guided through the collecting conveyor 58 to the common conveyor rail 53 which extends through the identification device 50. Consequently, the pieces of laundry 30 coming from all the separators 31 are guided together on the conveyor rail 53 upstream from the identification device 50 and progressively guided through the single identification device 50 and thus identified in terms of the desired sorting criteria.

After the pieces of laundry 30 have been identified, they are moved individually into the provided storage track 62 with the at least one corresponding sorting criterion and to do this the switches 63 are adjusted by a control system depending on the respective sorting criterion determined during the identification.

Pieces of laundry 30 of the respective storage track 62 are called off, preferably in batches, progressively and correctly sorted, from the respective storage track 62 of the sorting store 61 in order to be inserted manually at each loading point 41 into the two insertion machines 39 arranged next to each other. Pieces of laundry 30 of the same storage track 62 can thus be distributed according to a corresponding control system to the left-hand and the right-hand insertion machine 39. It is, however, also conceivable to supply the insertion machine 39 with pieces of laundry 30 of the same sort from one storage track 62 and to feed the other insertion machine 39 with pieces of laundry 30 of the same sort from a different storage track 62 of the sorting store 61. One insertion machine 39 is then loaded with pieces of laundry 30 of one sort and the other insertion machine with pieces of laundry 30 of a different sort.

In the region of the delivery loop 67 upstream of each loading point 41, the respective operator 49 inserts the pieces of laundry 30 manually into the loading clamps of the supplied double clamp 42 at the loading point associated therewith of the respective insertion machine 39. To do this, each operator 49 is supplied with a respective piece of laundry 30 at a lower removal point 72 of the respective delivery loop 67. The onward transport of the clamp 55 is hereby momentarily stopped at the removal point 72. The piece of laundry 30 then hangs down loosely at the removal point 72 from the clamp 55, and to be precise with the first corner 38 held by the clamp 55. The respective operator 49 then locates and grips the second corner 44, adjacent to the first corner 38, of the piece of laundry 30 and hangs it in a loading clamp 43 of the double clamp 42 at the loading point 41. The operator 49 then takes the first corner 38, still held by the clamp 55, of the piece of laundry 30 from the clamp 55 and inserts this first corner into the second loading clamp 43 of the double clamp 42.

Lastly, as described in the explanation of the method for the exemplary embodiment in FIGS. 1 and 2, the double clamp 42 with the two adjacent corners 38 and 44 of the edge 55 which is to be spread toward the spreading clamps and delivered thereto.

In the above described exemplary embodiments, the pieces of laundry 30 were delivered manually to insertion machines 39. The exemplary embodiments below provide a fully automatic delivery of the pieces of laundry 30 to the respective insertion machine 39, and to be precise preferably directly to spreading clamps.

Figure 11:
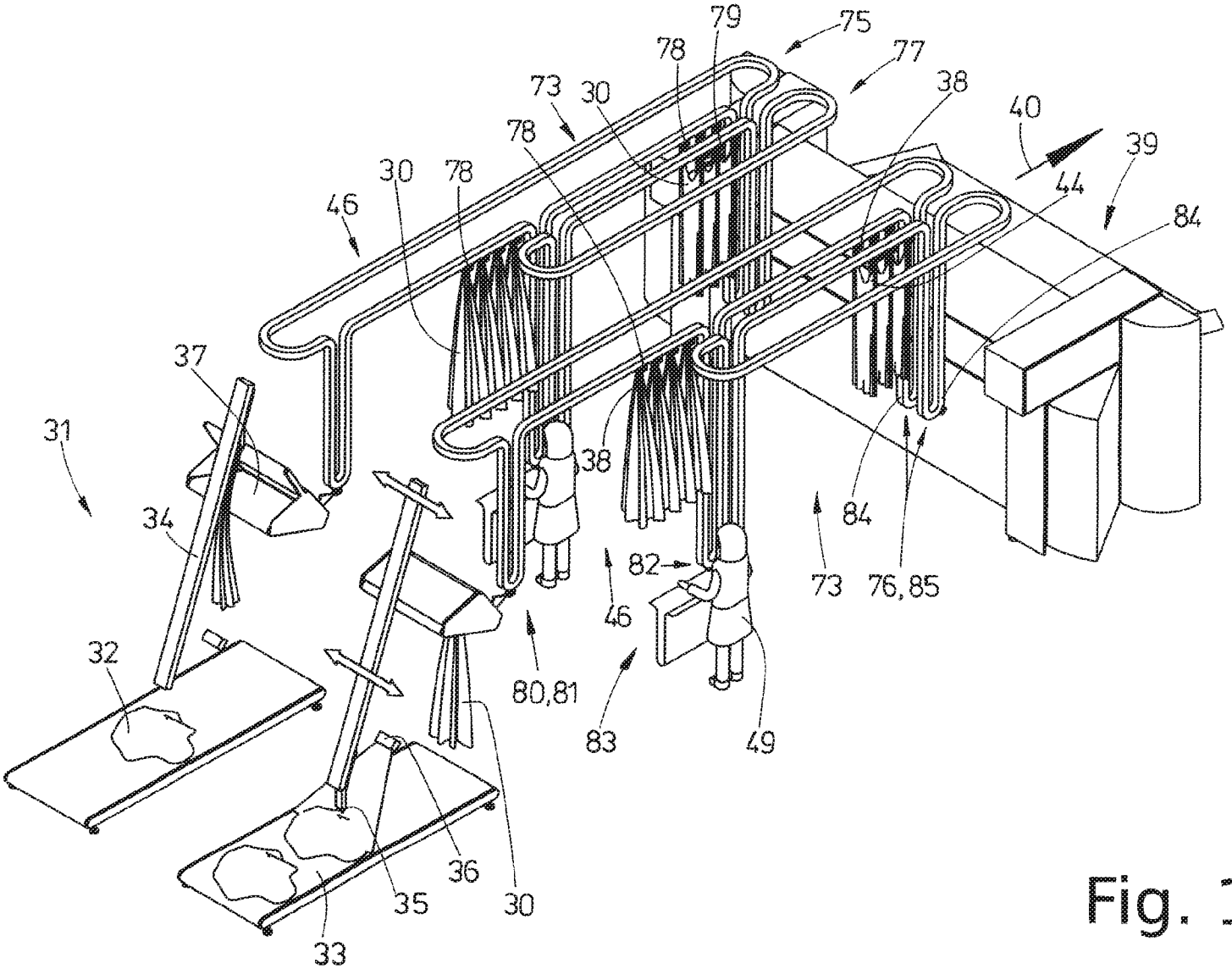
FIG. 11 shows a perspective view of a device for performing a method according to a sixth exemplary embodiment of the invention.
Figure 12:
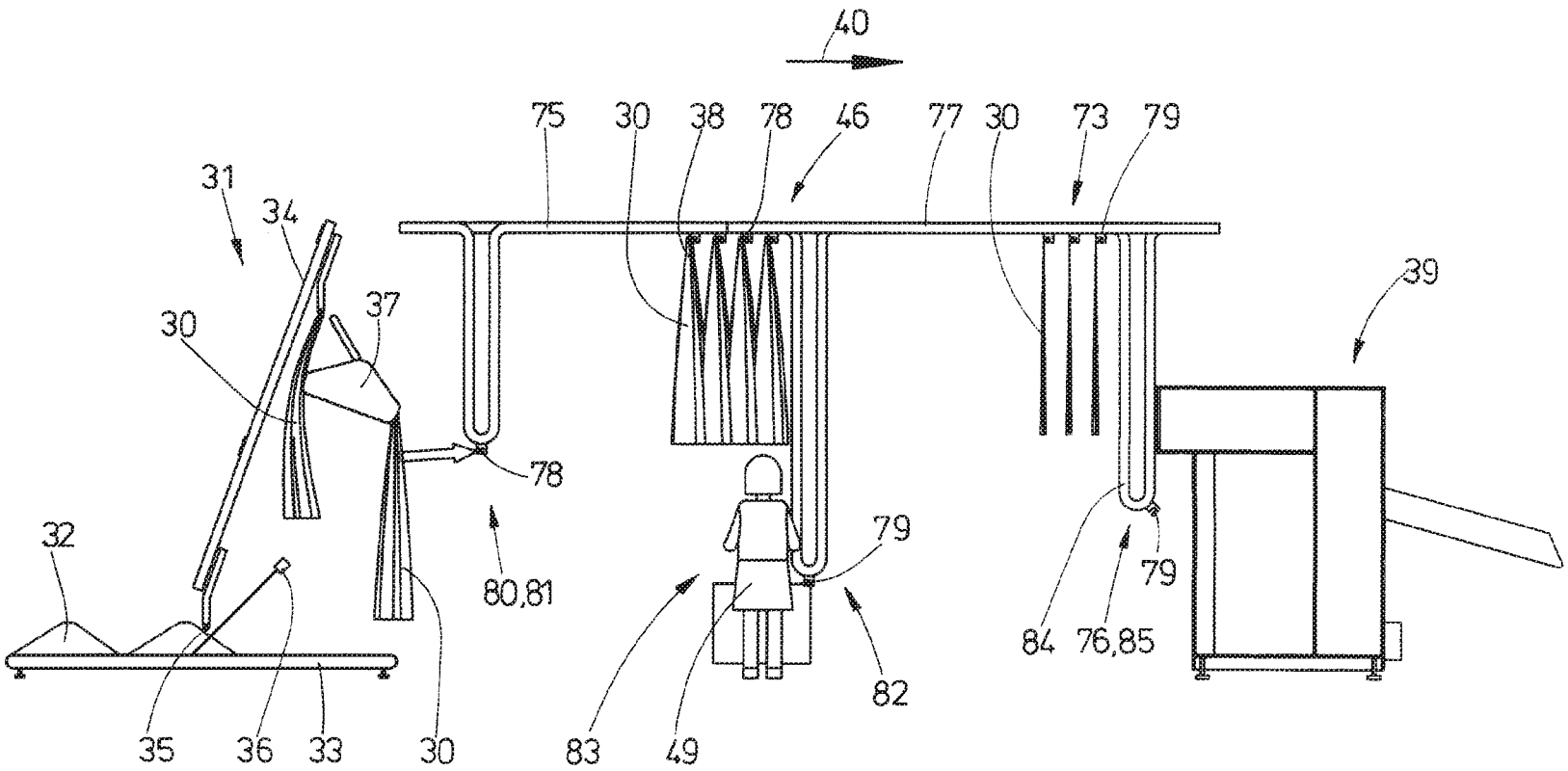
FIG. 12 shows a side view of the device in FIG. 11.

FIGS. 11 and 12 show a first exemplary embodiment of a device for transporting and automatically transferring the corners 38 and 44 of the pieces of laundry 30 to the respective insertion machine 39. A temporary store 73 is situated between each of the two separators 31 arranged next to each other and the insertion machine 39 having two loading points 76 situated next to each other. A workstation, in particular a manual workstation 83, for one operator 49 in each case is provided as part of each temporary store 73 downstream from a separator 31.

The respective temporary store 73 has two conveyor routes 75 and 77 which are different, in particular which differ in length. Both conveyor routes 75 and 77 are designed as a closed conveyor circuit with a circulating endless conveyor rail. Clamps 78, 79 can be displaced in a circuit along this conveyor rail.

A U-shaped transfer loop 80 of the longer conveyor route 75 of the respective temporary store 73 is situated close to the separator 31 associated with it. A lower U-shaped deflection of the transfer loop 80 of the conveyor route 75 forms a transfer point 81 in front of the respective separator 31. At a distance behind the transfer point 81 (viewed in the feed direction 40), the conveyor route 75 has a route portion (which is straight in the exemplary embodiment shown) which serves as the first temporary store 46. Thereafter the conveyor route 75 has a further U-shaped loop 82. A manual workstation 83 for the respective operator 49 is situated at the lower redirection point of this loop 82. A preferably straight section of the conveyor route 75 which serves as a second temporary store 73 then adjoins the loop 82. A U-shaped insertion loop 84 extending in a vertical plane is then situated at the end of this section in front of the insertion machine 39. A delivery point 85 is associated with a lower U-shaped section thereof.

The second shorter conveyor route 77 begins only in the region of the loop 82 of the manual workstation 83 and runs from there parallel to the conveyor route 75 as far as the insertion loop 84 in front of the insertion machine 39. A second set of clamps 79 can be displaced along the conveyor route 77. Whilst the clamps 78 of the conveyor route 75 which extends as far as the respective separator 31 hold the first corner 38 of the respective piece of laundry 30, the clamps 79 of the parallel conveyor route 77 are provided for receiving the second corner 44 of the respective piece of laundry 30.

The method according to the invention proceeds using the above described device in FIGS. 11 and 12 as follows:

The respective individual piece of laundry 30 is delivered, with the first corner 38 held by the separator 31, to the temporary store 46. In the case of the device shown, the first corner 38 of the piece of laundry 30 is delivered at the transfer point of a clamp 78 of the conveyor route 75 which extends as far as the separator 31. The piece of laundry 30 is then transported onward from the transfer point 81 along the conveyor route 75 and a reserve of multiple pieces of laundry 30 is stored temporarily upstream from the manual workstation 83. The pieces of laundry 30 here hang by the first corner 38 below a respective clamp 78.

The piece of laundry 30 situated at the front, with the clamp 78 which carries it, is moved out of the temporary store 46 upstream from the loop 82 and into the loop 82. The piece of laundry 30 with the clamp 78 is thus moved downward in the loop 82 of the conveyor route 75 to the manual workstation 83. The operator 49 here first visually checks that the first corner 38 of the piece of laundry 30 is correctly fitted in the clamp 78 carrying said corner. If necessary, the operator 49 makes a correction by moving the first corner 38 of the piece of laundry 30 into a favorable position for further processing. The operator here makes a correction to the clamped-in position of the piece of laundry 30 in the relevant clamp 78. The operator 49 then locates and grips the second corner 44 of the piece of clothing 30 and inserts it, in an optimal clamping position, into a free clamp 79, supplied at the manual workstation 83, of the second conveyor route 77. This may also take place before the first corner 38 of the piece of laundry 30 is checked and possibly reclamped. Because the loops 82 of both conveyor routes 75 and 77 run parallel and next to each other at the manual workstation 83, the operator 49 can insert the second corner 44 into a free clamp 79 of the conveyor route 77 ergonomically at the manual workstation 83 and if necessary check and/or correct the fit of the first corner 38 in the clamp 78 of the first conveyor route 75.

After both corners 38 and 44 of the edge 45 have been inserted at the manual workstation 83 into a respective clamp 78 and 79 of each conveyor route 75 and 77, the respective piece of laundry 30, both corners 38 and 44 of which are now held in their own clamps 78 and 79, is transported onward along the conveyor routes 75 and 77 and then temporarily stored in a part of the temporary store 73 which is downstream from the manual workstation 83. The clamps 78, 79 holding the two corners 30 and 44 are thus situated next to but apart from each other, i.e. the piece of laundry 30 is oriented transversely to the feed direction 40.

As soon as the spreading clamps of the insertion machine 39 are ready to transfer the next piece of laundry 30, a control system releases the feeding of the piece of laundry 30 which is first (viewed in the feed direction 40) from the temporary store 73 to the insertion loops 84 of both conveyor routes 75 and 77 upstream from the insertion machine 39. The respective piece of laundry 30 is then moved with both clamps 78 and 79 simultaneously to the spreading clamps or the like of the insertion machine 39 and automatically delivered simultaneously or synchronously to them at the delivery point 85, as a result of which each of the adjacent corners 38 and 44 of the front edge 45 of the piece of laundry 30 passes into a spreading clamp which, when they move apart from each other, then stretch the edge 45 and thus spread out the piece of laundry 30.

After the piece of laundry 30 has been delivered to the spreading clamps, the clamps 78 and 79 of each conveyor route 75, 77, which are now free, are returned empty to the start of the respective conveyor route 75, 77 in front of a separator 31 or the manual workstation 83.

Figure 13:
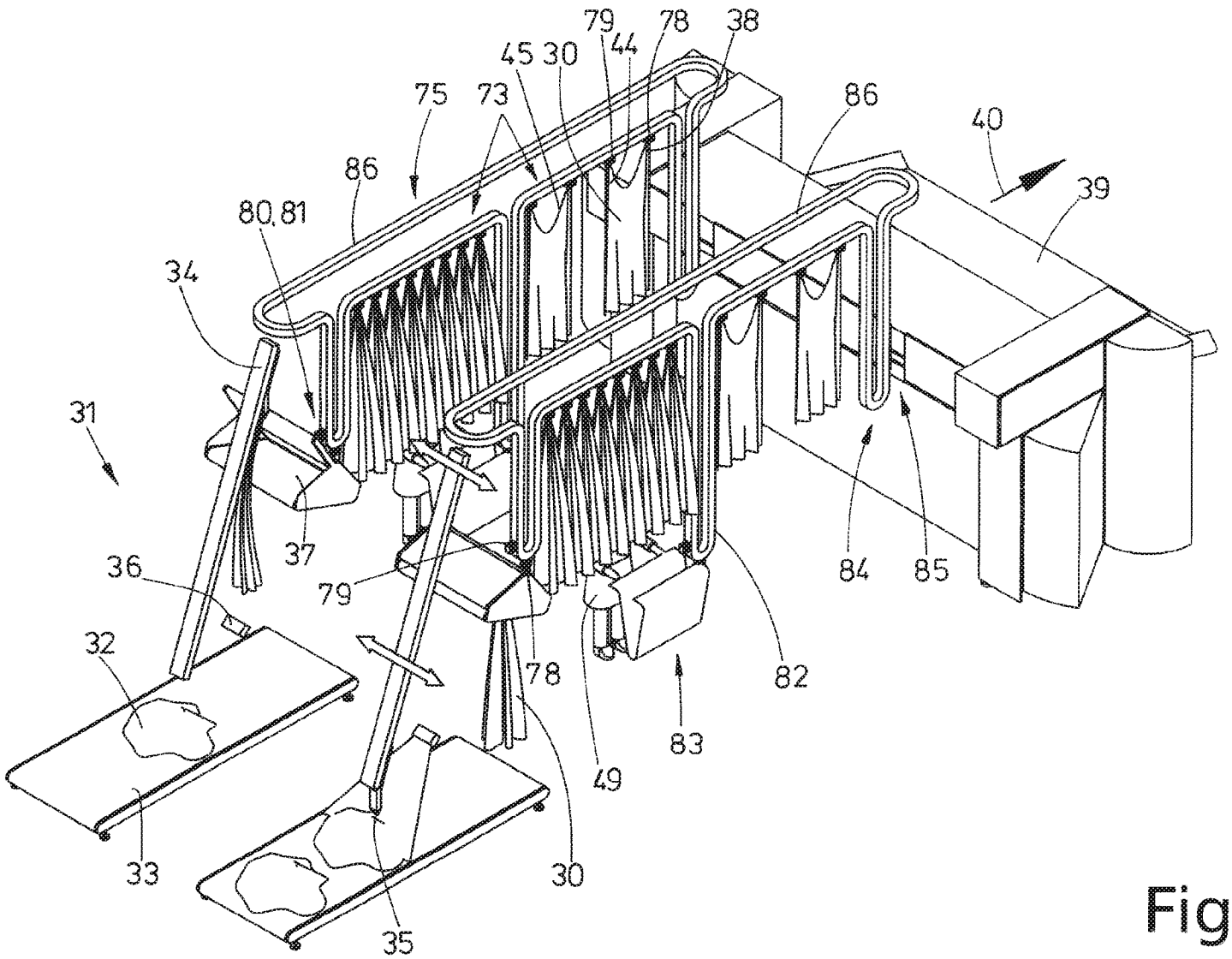
FIG. 13 shows a perspective view of a device for performing a method according to a seventh exemplary embodiment of the invention.
Figure 14:
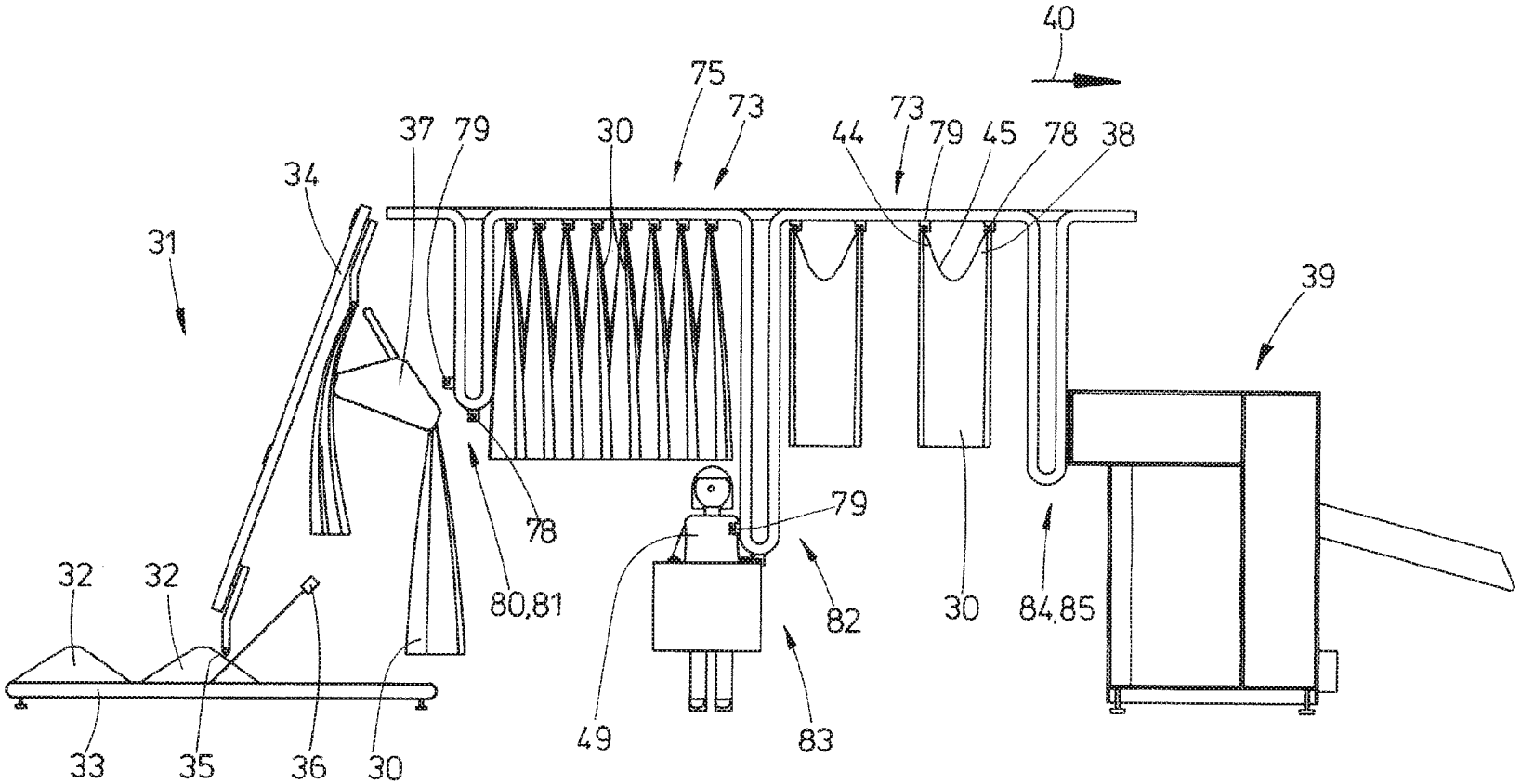
FIG. 14 shows a side view of the device in FIG. 13.

The device shown in FIGS. 13 and 14 differs from the one in FIGS. 11 and 12 only in that just one circulating conveyor route 75 is arranged between each separator 31 and the delivery point 85 associated therewith of the insertion machine 39. This conveyor route 75 corresponds to the one in FIGS. 11 and 12. A temporary store 73, which has two split temporary store sections, is formed along this conveyor route 75 and to be precise before and after the loop 82 with the manual workstation 83.

In contrast to the device in FIGS. 11 and 12, multiple pairs of successive clamps 78 and 79 can be displaced along the conveyor route 75. The clamps 78 and 79 which succeed one another in the feed direction 40 serve to receive the adjacent corners 38 and 44 of the edge 45 of the piece of laundry 30 and can thus be displaced along the conveyor route 75, one behind the other.

The method using the device in FIGS. 13 and 14 proceeds as follows:

The respective piece of laundry is delivered, by the first corner 38 held by the separator 31, to a preferably first clamp 78 of the pair of clamps on the conveyor route 75 at the transfer point of the transfer loop 80. The piece of laundry 30 which then hangs down by the first corner 38 from the first clamp 78 of the pair of clamps on the conveyor route 75 is temporarily stored in a first initial storage section of the temporary store 73. The frontmost piece of laundry 30 is then called up from the temporary store 73 by the operator 49 at the manual workstation 83. This piece of laundry 30 then passes to the lower U-shaped redirection point of the loop 82 in the region of the manual workstation 83. The operator 49 here hangs the second corner 44, hanging down from the clamp 78, of the edge 45 of the piece of laundry 30 in the following second clamp 79 of the pair of clamps of the conveyor route 75. The operator 49 then, or possibly beforehand, checks that the first corner 38 automatically inserted beforehand in the clamp 78 is fitted correctly and corrects it if necessary. After both adjacent corners 38 and 44 of the edge 45 of the piece of laundry 30 have then been inserted into successive clamps 78 and 79 of the temporary store 73, the pieces of laundry 30 are transported onward along the conveyor route 75 and temporarily stored again in the second storage section of the temporary store 73. The two corners 38 and 44 are then situated in clamps 78, 79, which follow each other in terms of the feed direction 40, of the same conveyor route 75 of the temporary store 73.

As soon as the spreading clamps are ready to transfer the next piece of laundry 30, the (next) piece of laundry 30 situated upstream from the insertion loop 84 is called off with corners 38 and 44 following each other for delivery to the spreading clamps. The clamps 78, 79 holding the corners 38 and 44 are here moved through the insertion loop 84 one behind the other and thus, at the delivery point 85 to the insertion machine 39, the first corner 38 of the piece of laundry 30 is first automatically delivered from the clamp 78 holding it to the first spreading clamp of the spreading device of the insertion machine 39. The following clamp 78, 79 is then moved further on the insertion loop 84 and the second corner 44 of the edge 45 of the piece of laundry 30 is also delivered automatically from the clamp 79 to the second spreading clamp of the spreading device. The corners 38 and 44 are then moved apart by the spreading clamps and the edge 45 of the piece of laundry 30 is thus stretched. The empty clamps 78, 79 are then transported back from the respective delivery point 85, via a return section 86 of the conveyor route 75, to the transfer loop 80 in front of the separator 31.

Figure 15:
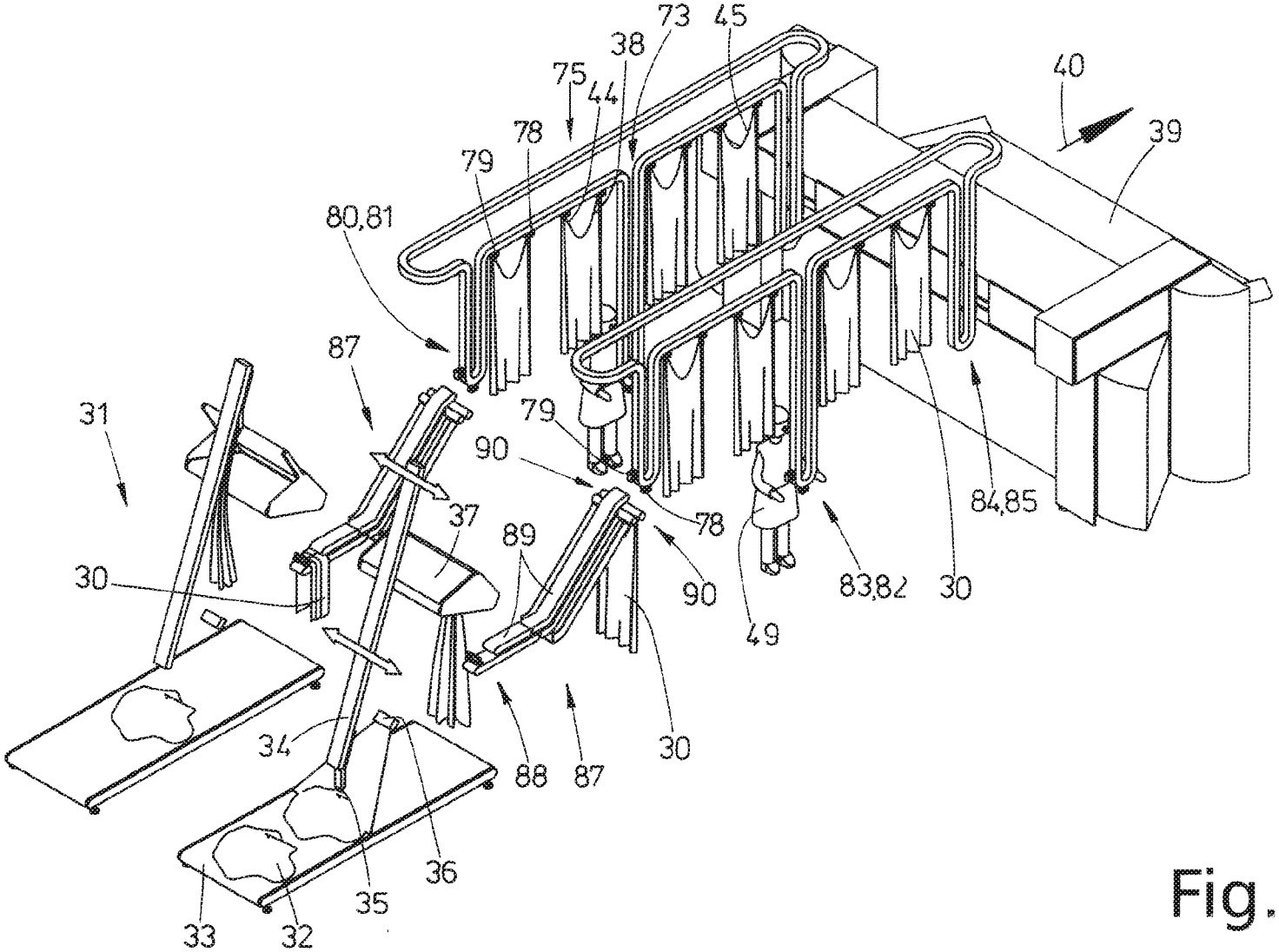
FIG. 15 shows a perspective view of a device for performing a method according to an eighth exemplary embodiment of the invention.
Figure 16:
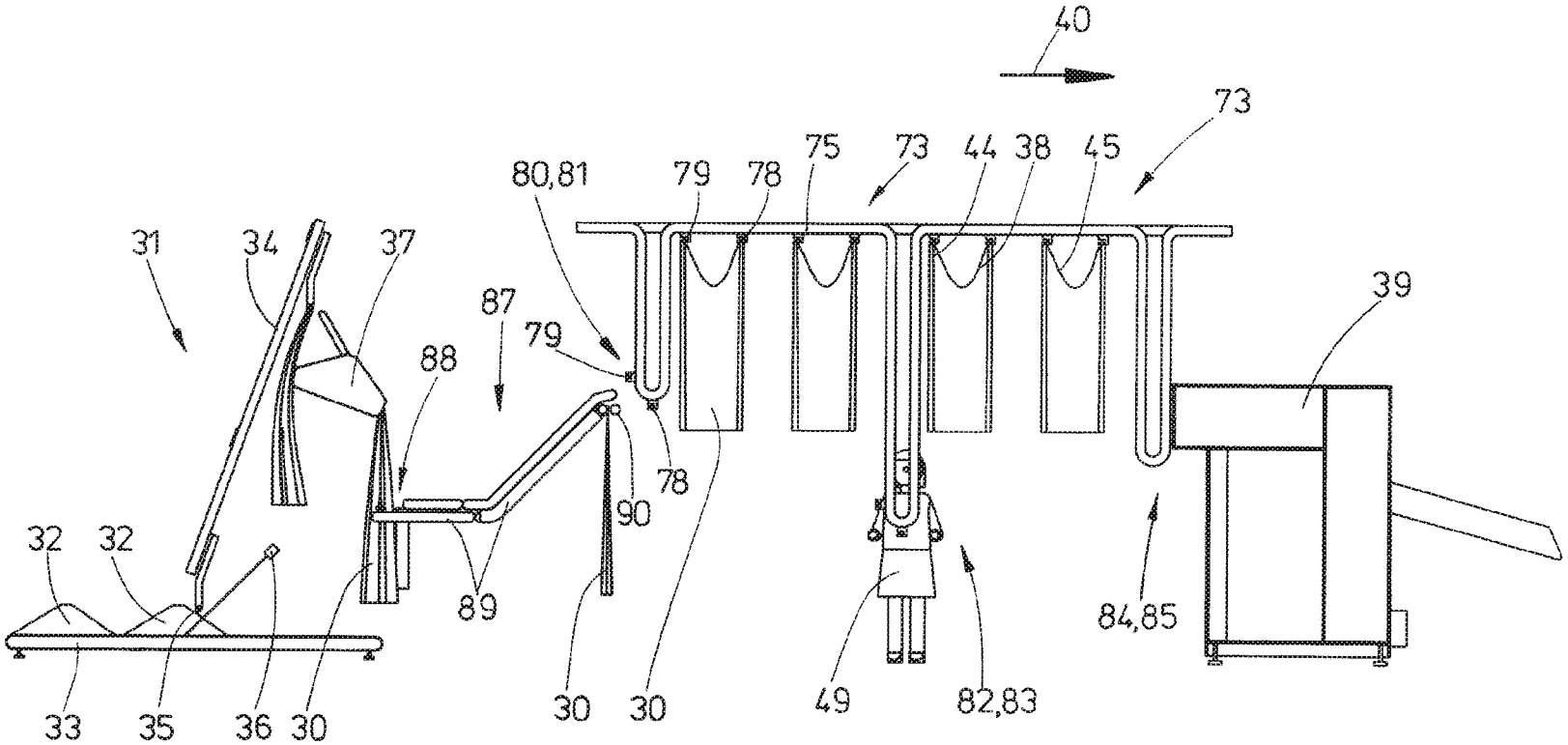
FIG. 16 shows a side view of the device in FIG. 15.

The device in FIGS. 15 and 16 differs from the one in FIGS. 13 and 14 only in that a handover device 87 is arranged between the respective separator 31 and the transfer loop 80 of the conveyor route 75 with the temporary store 73. The handover device 87 is designed such that a piece of laundry 30 coming from the separator 31 can be laid in an approximate U-shape over its loading point 88. The piece of laundry 30 is transported during the onward transport by the handover device 87 having multiple pairs of belt conveyors 89 situated above one another and consecutively to two corner-grabbing devices 90 arranged on opposite sides of the end of the last pair of belt conveyors 89. The corner-grabbing device 90 locates the adjacent corners 38 and 44 of the edge 45 of the piece of laundry 30 and fixes it in place for automatic delivery to the successive clamps 78, 79 of the conveyor route 75 of the temporary conveyor 73.

The device in FIGS. 15 and 16 otherwise corresponds to the one in FIGS. 13 and 14 such that reference is made to the above relevant description.

The method proceeds using the device in FIGS. 15 and 16 as follows:

The piece of laundry 30 extracted and separated automatically from the pile of laundry 32 by the separator 31 is held, held ready, or supplied by the separator at the first corner 38. Leaving the separator 31, the piece of laundry 30 is then laid in a U-shape over the loading point 88 of the handover device 87. This can be effected directly by the separator 31 or an interposed depositing device. The piece of laundry 30 is then transported from the loading point 88, between the successive pairs of belt conveyors 89 in the feed direction 40 to the corner-grabbing device 90 of the handover device 87 and thus be stretched apart in the feed direction 40 such that pairs of rollers, arranged on opposite sides of the rear pair of belt conveyors 89, of the corner-grabbing devices 90 each fix in place a corner, i.e. the first corner 38, on the one hand, and the second corner 44 of the edge 45 of the piece of laundry 30, on the other hand. The piece of laundry 30 which is thus held by the handover device by both corners 38 and 44 is then delivered to following clamps 78, 79 of a pair of clamps of the conveyor route 75 of the temporary store 73, and to be precise one after the other.

For example, when the first clamp 78 of the pair of clamps is stopped temporarily at the transfer point 81 of the transfer loop 80, the first corner 38 of the piece of laundry 30 is inserted into this clamp 78. The clamps 78, 79 are then transported onward somewhat along the conveyor route 75 such that a following second clamp 79 of the pair of clamps is ready at the transfer point 81 behind the handover device 87. The second corner 44 of the piece of laundry 30 is here then delivered automatically to this second following clamp 79 of the respective pair of clamps. The respective piece of laundry 30 then hangs by the first corner 38 on a clamp 78 of the conveyor route 75 and by the second corner 44 on the following second clamp 79 of the pair of clamps of the conveyor route 75.

The method then proceeds in exactly the same way as described in connection with the exemplary embodiment in FIGS. 13 and 14. Reference is made hereto.

Figure 18:
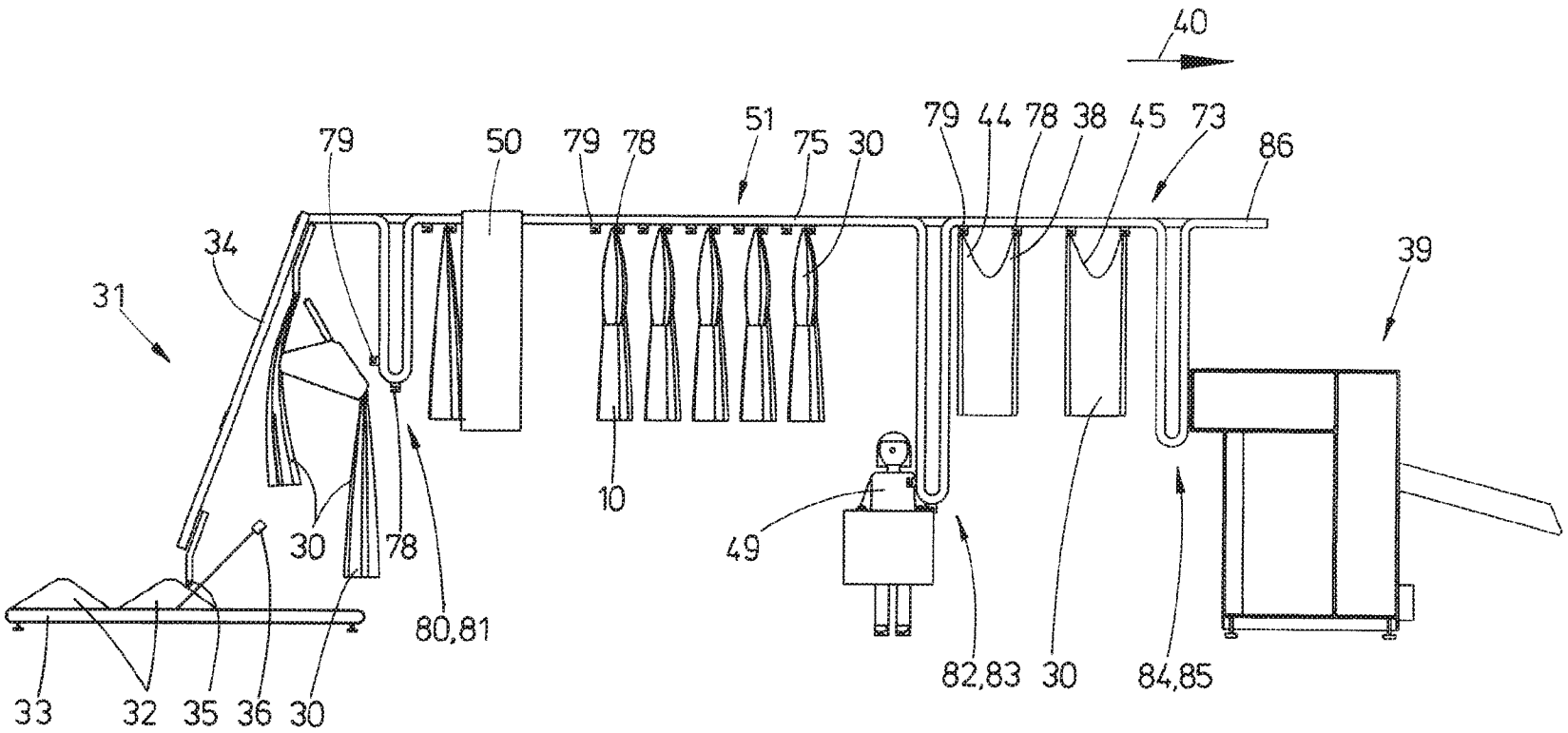
FIG. 18 shows a side view of the device in FIG. 17.

The device shown in FIGS. 7 and 18 corresponds essentially to the device in FIGS. 13 and 14. The sole difference is that the conveyor route 75 has a sorting store 51 with an identification device 50 between the U-shaped transfer loop 80 and the loop 82 at the manual workstation 83.

The identification device 50 of the device shown here corresponds, for example, to the one in FIGS. 3 and 4. In the exemplary embodiment in FIGS. 17 and 18, the sorting store 51 is designed in the manner of the one in FIGS. 3 and 4. In contrast to FIGS. 3 and 4, however, the clamps 78, 79 circulate on the conveyor route 75 in each case in successive groups of two clamps 78, 79 arranged one after the other (as in the exemplary embodiment in FIGS. 13 and 14). In the present exemplary embodiment, the sorting store 51 also has two parallel storage tracks 52 such that it can receive pieces of laundry 30 of two different types, correctly sorted.

The storage tracks 52 meet again at the end of the sorting store 51 at a connection node 64 such that the pieces of laundry 30 from different storage tracks 52 of the sorting store 51 continuously run past the manual workstation 83.

The method proceeds using the device in FIGS. 17 and 18 as follows:

As in the exemplary embodiment in FIGS. 13 and 14, the respective piece of laundry 30 is inserted by the separator 31 by its first corner 38 into a first clamp 78 of the respective pair of successive clamps 78, 79. The piece of laundry 30 which then hangs down loosely from the clamp 78 by the first corner 38 is transported through the identification device 50 and the sorting criteria of the respective piece of laundry 30 are thus identified.

Pieces of laundry 30 which correspond to the same sorting criteria are passed onto the same storage track 52 owing to a corresponding setting of the switch 54. Such pieces of laundry 30 which do not correspond to the sorting criterion or meet a different predetermined sorting criterion are in contrast, when the switch 54 is reset, transported onto the other parallel storage track 52. If more than two different sorting criteria need to be met, the sorting store 51 has more than two in particular parallel storage tracks 52.

The sort of pieces of laundry 30 which is called off in a selective fashion from one or other storage track 52 is transported from the sorting store 51 through a following temporary store 73 to the loop 82 at the manual workstation 83. If it is intended for other pieces of laundry 30 to be inserted into the insertion machine 39, pieces of laundry 30 are transported from the other storage track 52 to the same loop 82 at the manual workstation 83. The process followed at the manual workstation 83 up to the delivery of the two adjacent corners 38 and 44 of the edge 45 into the spreading clamps of the insertion machine 38 corresponds to the procedure which was described in connection with the exemplary embodiments in FIGS. 13 to 16. Reference is made hereto.

Figure 17:
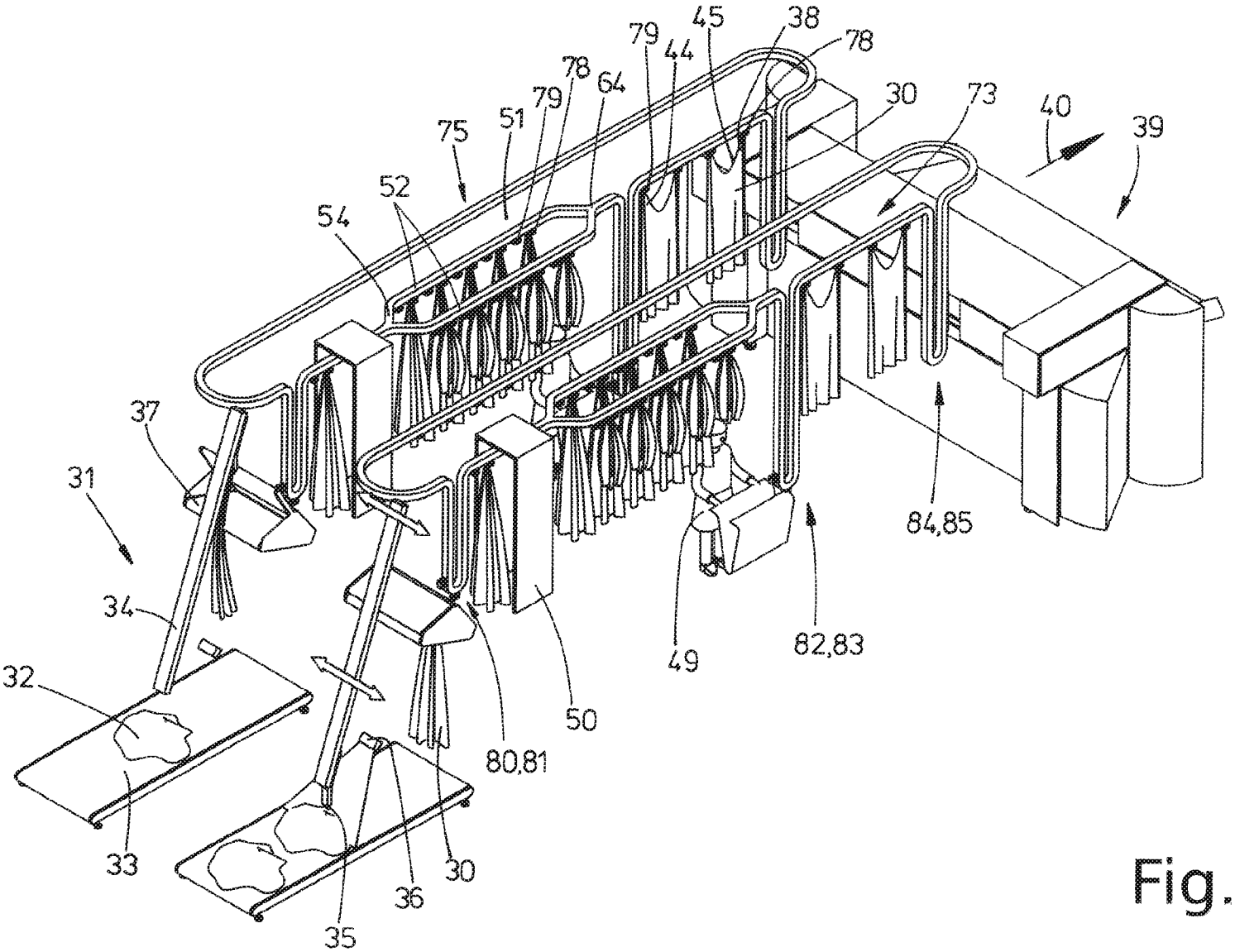
FIG. 17 shows a perspective view of a device for performing a method according to a ninth exemplary embodiment of the invention.
Figure 19:
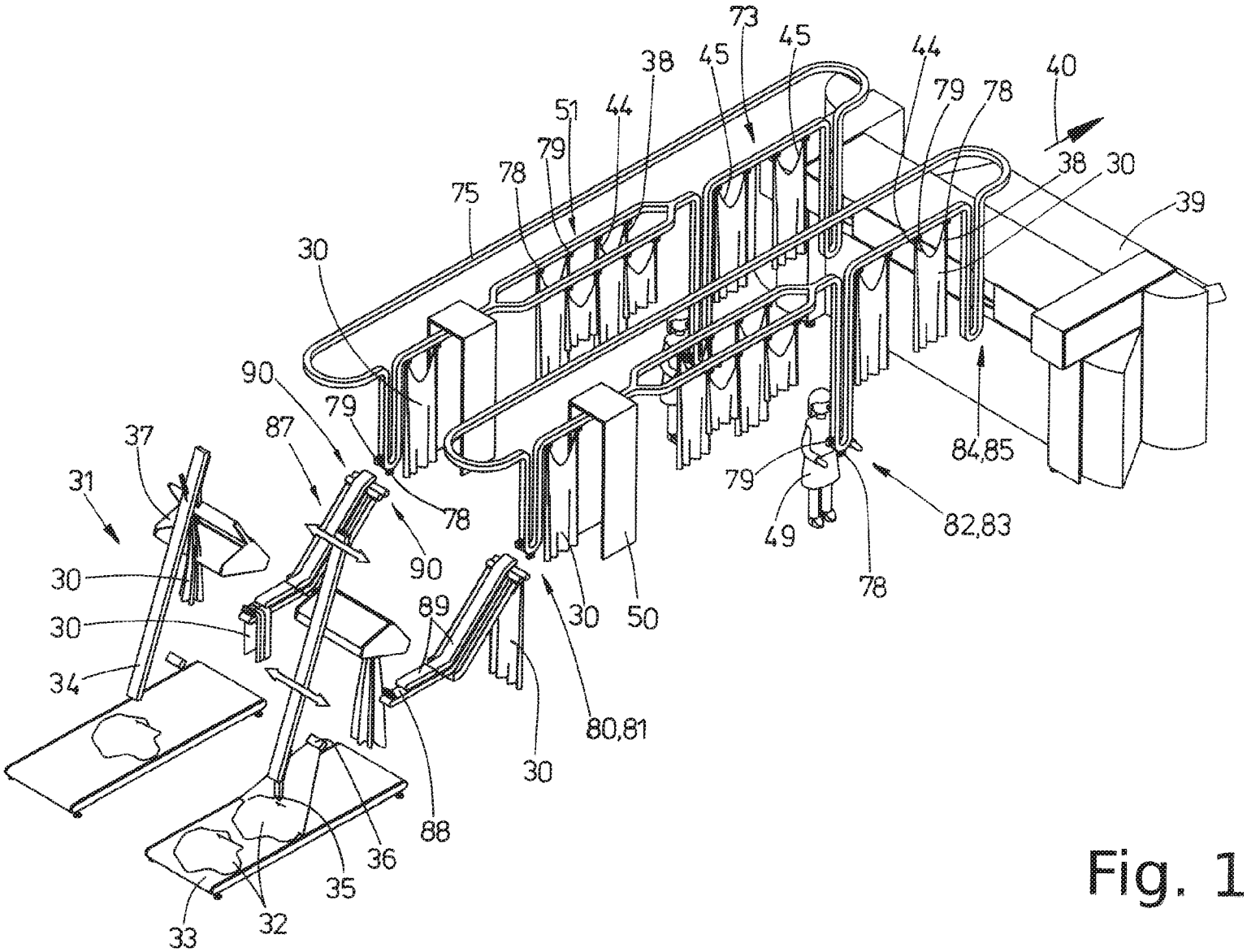
FIG. 19 shows a perspective view of a device for performing a method according to a tenth exemplary embodiment of the invention.
Figure 20:
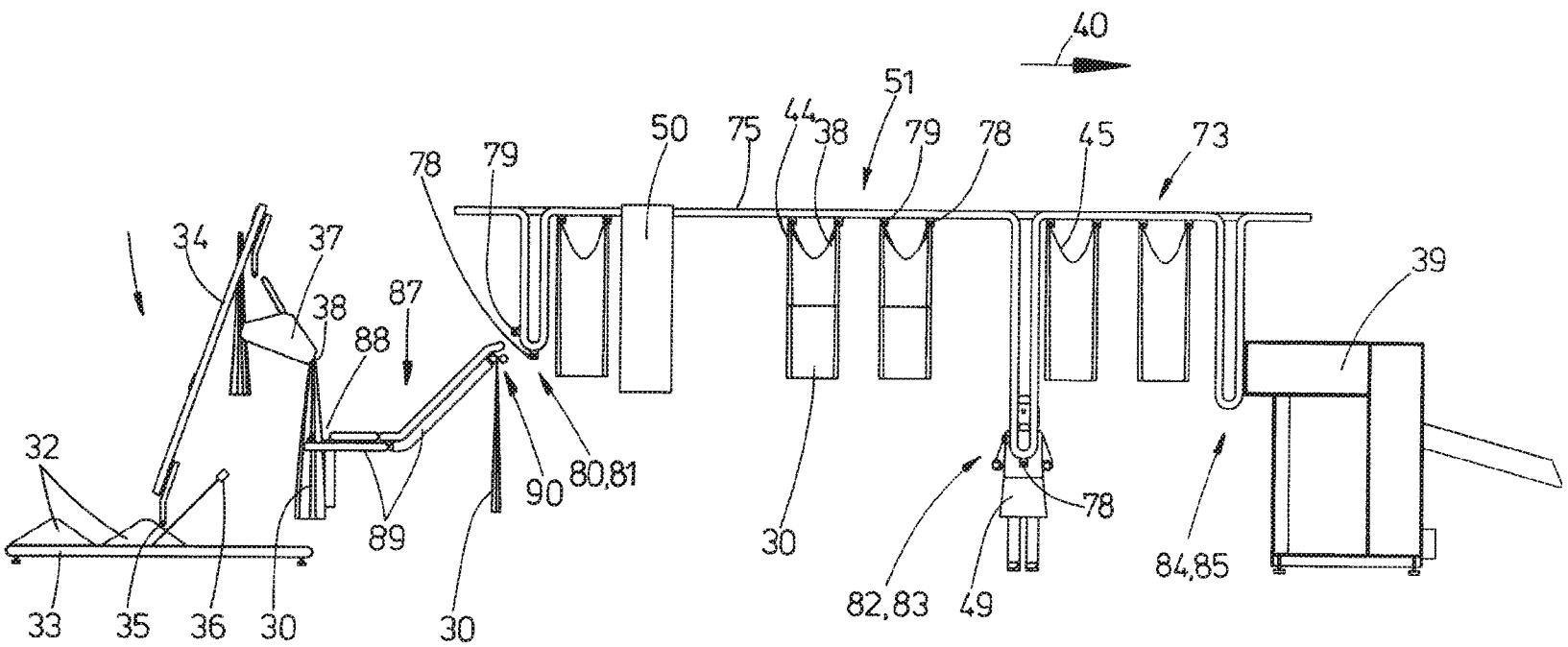
FIG. 20 shows a side view of the device in FIG. 19.

The device of the exemplary embodiment in FIGS. 19 and 20 mostly corresponds to the above described device in FIGS. 17 and 18. The only difference is that a respective handover device 87 is provided between the respective separator 31 and the sorting store 51 with the identification device 50. Each separator 31 is thus followed by an identically designed handover device 87. As a result, in the method of this exemplary embodiment (as in the exemplary embodiment in FIGS. 15 and 16), both adjacent corners 38 and 44 of that edge 45 of the piece of laundry 30 which is to be spread by the insertion machine 39 can also be inserted automatically by the corner-grabbing devices 90 one after the other into successive clamps 78, 79 of a pair of clamps for receiving both corners 38 and 44. After the adjacent corners 38 and 44 of the edge 45 of the piece of laundry 30 have been inserted one behind the other into the clamps 78 and 79 of the conveyor route 75 by the handover device 87 or have been transferred by the clamps 78 and 79, the method proceeds in exactly the same way as described above in connection with the exemplary embodiment in FIGS. 17 and 18, to which 87 reference is made in this respect.

LIST OF REFERENCE NUMERALS

30 piece of laundry
31 separator
32 pile of laundry
33 belt conveyor
34 inclined section
35 gripper
36 camera
37 supply device
38 first corner
39 insertion machine
40 feed direction
41 loading point
42 double clamp
43 loading clamp
44 second corner
45 edge
46 temporary store
47 conveyor rail
48 clamp
49 operator
50 identification device
51 sorting store
52 storage track
53 conveyor rail
54 switch
55 clamp
56 temporary store
57 conveyor rail
58 collecting conveyor
59 transfer loop
60 redirection point
61 sorting store
62 storage track
63 switch
64 connection node
65 feed track
66 switch
67 delivery loop
68 return route
69 return rail
70 feed route
71 transfer point
72 removal point
73 temporary store
74 workstation
75 conveyor route
76 loading point
77 conveyor route
78 clamp
79 clamp
80 transfer loop
81 transfer point
82 loop
83 manual workstation
84 insertion loop
85 delivery point
86 return section
87 handover device
88 loading point
89 pair of belt conveyors
90 corner-grabbing device

What is claimed is:

1. A method for feeding pieces of laundry (30) to an insertion machine (39) in order to spread out and insert pieces of laundry (30) into a wringer, comprising gripping and separating the pieces of laundry (30) automatically and then delivering each individual piece of laundry (30) to the insertion machine (39) with adjacent corners (38, 44) of an edge (45), wherein a piece of laundry (30) held by a first corner (38) is in each case held ready by the separator (31), wherein the respective piece of laundry (30) hangs down loosely from its first corner (38) held by the separator (31), and wherein the respective piece of laundry (30), held by the separator (31) by a first corner (38) and hanging down from this corner (38) is supplied to an operator (49) by the separator (31).

2. The method as claimed in claim 1, wherein, in the region of a conveyor route (47, 53, 57, 75, 77), the second corner (44), adjacent to the first corner held in a clamp (48, 55, 78, 79), of the edge (45) of the piece of laundry (30) is located manually.

3. The method as claimed in claim 1, wherein, in the region of at least one sorting store (51, 61), the second edge (44), adjacent to the first corner (38) held in a clamp (48, 55, 78, 79) of the at least one sorting store (51, 61), of the edge (45) of the piece of laundry (30) is located manually.

4. The method as claimed in claim 3, wherein the manually located second corner (44) of the edge (45) of the piece of laundry (30) is inserted manually into the clamp (48, 55, 78, 79) of the at least one sorting store (51, 61).

5. The method as claimed in claim 3, wherein, during its passage through the at least one sorting store (51, 61), the second corner (44) of the respective piece of laundry (30), hanging by the adjacent first corner (38) of the edge (45) on a clamp (43, 48, 55, 78, 79) of the at least one sorting store (51, 61) is located manually and inserted manually into a second clamp (78, 79) of the at least one sorting store (51, 61).

6. The method as claimed in claim 1, wherein the piece of laundry (30) supplied to the operator (49) by the separator (31) is inserted manually by the operator (49) into the insertion machine by the first corner (38) supplied by the separator (31) and the second corner (44) of the edge (45) of the piece of laundry.

7. The method as claimed in claim 1, wherein the piece of laundry (30) held by the separator (31) at a first corner (38) and supplied in this way is delivered automatically by this first corner (38) by the separator (31) to a clamp of at least one store (46, 56, 73; 51 61).

8. The method as claimed in claim 1, wherein the piece of laundry (30) held by the separator (31) at a first corner (38) and supplied in this way is delivered automatically by this first corner (38) by the separator (31) to a clamp of an identification device (50).

9. The method as claimed in claim 1, wherein the respective piece of laundry (30) is automatically delivered to the insertion machine (39) with both adjacent corners (38, 44) of the edge (45) from at least one temporary store (46, 56, 73).

10. The method as claimed in claim 1, wherein the respective piece of laundry (30) is automatically delivered to the insertion machine (39) with both adjacent corners (38, 44) of the edge (45) from at least one sorting store (51, 61).

11. The method as claimed in claim 1, wherein the position of the at least one corner (38, 44), inserted automatically into a clamp (43, 48, 55, 78, 79), of the piece of laundry (30) is checked visually by at least one operator (49) and if the at least one corner (38, 44) is in an incorrect position, the incorrect position is corrected.

12. The method as claimed in claim 11, wherein the position of the at least one corner (38, 44), inserted automatically into a clamp (43, 48, 55, 78, 79) is checked and if necessary corrected only for those pieces of laundry (30) on which high demands have been placed with regard to ironing quality of those pieces of laundry (30) in a later ironing step.

13. A method for feeding pieces of laundry (30) to an insertion machine (39) in order to spread out and insert pieces of laundry (30) into a wringer, comprising gripping and separating the pieces of laundry (30) automatically and then delivering each individual piece of laundry (30) to the insertion machine (39) with adjacent corners (38, 44) of an edge (45), wherein a piece of laundry (30) held by a first corner (38) is in each case held ready by the separator (31), and wherein at least one second corner (44), adjacent to the first corner (38) supplied by the separator (31), of an edge (45) is inserted manually into a clamp (43, 48, 55, 78, 79).

14. The method as claimed in claim 13, wherein the insertion machine (39) spreads out the edge (45) delimited by the first corner (38) and the adjacent second corner (44) in order to stretch the edge (45) between the two adjacent corners (38, 39) of the piece of laundry (30).

15. A method for feeding pieces of laundry (30) to an insertion machine (39) in order to spread out and insert pieces of laundry (30) into a wringer, comprising gripping and separating the pieces of laundry (30) automatically and then delivering each individual piece of laundry (30) to the insertion machine (39) with adjacent corners (38, 44) of an edge (45), wherein a piece of laundry (30) held by a first corner (38) is in each case held ready by the separator (31), and wherein the second corner (44), located manually in the region of a conveyor route (47, 53, 57, 75, 77), of the edge (45) of the piece of laundry (30) is inserted manually into a clamp (48, 55, 78, 79) of the conveyor route (47, 53, 57, 75, 77).

16. A method for feeding pieces of laundry (30) to an insertion machine (39) in order to spread out and insert pieces of laundry (30) into a wringer, comprising gripping and separating the pieces of laundry (30) automatically and then delivering each individual piece of laundry (30) to the insertion machine (39) with adjacent corners (38, 44) of an edge (45), wherein a piece of laundry (30) held by a first corner (38) is in each case held ready by the separator (31), and wherein, at the end of at least one store (46, 56, 73; 51, 61), at least one of the adjacent corners (38, 44) of the edge (45) of the piece of laundry (30) to be spread by the insertion machine (39) is inserted manually into a clamp (43, 48, 55, 78, 79).

17. The method as claimed in claim 16, wherein, at the end of the at least one store (46, 56, 73; 51, 61), both of the adjacent corners (38, 44) of the edge (45) of the piece of laundry (30) to be spread by the insertion machine (39) are inserted manually into two clamps (43, 48, 55, 78, 79).

18. A method for feeding pieces of laundry (30) to an insertion machine (39) in order to spread out and insert pieces of laundry (30) into a wringer, comprising gripping and separating the pieces of laundry (30) automatically and then delivering each individual piece of laundry (30) to the insertion machine (39) with adjacent corners (38, 44) of an edge (45), wherein a piece of laundry (30) held by a first corner (38) is in each case held ready by the separator (31), and wherein, after the first corner (38) of the piece of laundry (30) has been automatically transferred by a clamp (43, 48, 55, 78, 79), the second corner (44) of the edge (45) of the piece of laundry (30) is located manually and inserted into a clamp (43, 48, 55, 78, 79) provided for this purpose.

19. A method for feeding pieces of laundry (30) to an insertion machine (39) in order to spread out and insert pieces of laundry (30) into a wringer, comprising gripping and separating the pieces of laundry (30) automatically and then delivering each individual piece of laundry (30) to the insertion machine (39) with adjacent corners (38, 44) of an edge (45), wherein a piece of laundry (30) held by a first corner (38) is in each case held ready by the separator (31), and wherein, during its passage through the at least one temporary store (46, 56, 73), the second corner (44) of the respective piece of laundry (30), hanging by the adjacent first corner (38) of the edge (45) on a clamp (43, 48, 55, 78, 79) of the at least one temporary store (46, 56, 73) is located manually and inserted manually into a second clamp (78, 79) of the at least one temporary store (46, 56, 73).

* * * * *